US005330280A

United States Patent [19]

Kaneda et al.

[11] Patent Number: 5,330,280

[45] Date of Patent: Jul. 19, 1994

[54] FILING APPARATUS OF BOTH-SIDE OPENING/CLOSING TYPE

[75] Inventors: Shinichi Kaneda, Nara; Takio Kiyomi, Kyoto, both of Japan

[73] Assignee: Kokuyo Kabushiki Kaisha, Japan

[21] Appl. No.: 934,634

[22] PCT Filed: Dec. 3, 1991

[86] PCT No.: PCT/JP91/01683

§ 371 Date: Sep. 14, 1992

§ 102(e) Date: Sep. 14, 1992

[51] Int. Cl.[5] ..... B42F 3/02

[52] U.S. Cl. ..... 402/49

[58] Field of Search ..... 402/46, 48, 49, 27, 402/51, 54, 55, 56

[56] References Cited

U.S. PATENT DOCUMENTS 2,171,488 8/1939 Bigg et al. ..... 402/49
4,693,625 9/1987 Ohminato ..... 402/49 X

FOREIGN PATENT DOCUMENTS 62-005975 1/1987 Japan .
63-149777 10/1988 Japan .
2115485 9/1990 Japan .

*Primary Examiner*—Mark Rosenbaum
*Assistant Examiner*—Willmon Fridie, Jr.
*Attorney, Agent, or Firm*—Bruce L. Adams; Van C. Wilks

[57] ABSTRACT

The invention relates to a filing apparatus of the both-side opening and closing type in which a pair of right and left opening/closing members (52) coupled to the right and left side edges of an attaching member (41) can be opened and closed from any one of the front, back, right and left side edges by an operating member (61) provided for the attaching member (41). The filing apparatus comprises: tile attaching member (41) having axial pipes (44) at the right and left side edges; a pair of right and left opening/closing members (52) in which filing rods are projected on the inner surface and axial pipes (56) which are coupled to the axial pipes (44) are provided; coupling mechanisms which are arranged at the right and left positions of the attaching member (41) and have a pair of operating rods which are relatively moved between the inoperative position where the opening/closing members (52) are rotatably coupled to the attaching member (41) by a coupling rod (65) and the operative position to release the coupling state of them; front and back operating members (61) for operating the right and left coupling mechanisms from the inoperative position to the operative position, respectively; and a holding mechanism which holds the operative position of the coupling mechanism by a holding lever (67) and releases the holding state of the holding lever when the opening/closing members (52) are in the coupling state. One of the opening/closing members (52) can be opened from any one of the front, back, right, and left positions of the attaching member (41).

31 Claims, 24 Drawing Sheets

FILING APPARATUS OF BOTH-SIDE OPENING/CLOSING TYPE

FIELD OF THE INVENTION

The invention relates to a filing apparatus which is attached to the inner surface of a rear side cover of a cover plate which is constructed by continuously providing a front cover, a back cover, a rear side cover so as to be freely bent and which files sheets by filing rods. More particularly, the invention relates to a filing apparatus of the both-side opening/closing type in which opening/closing members having filing rods which are pierced into filing holes formed in sheets are respectively rotatably attached by coupling means to both side surfaces of an attaching member which is attached to the inner surface of a rear side cover and attaching-/detaching operations of the opening/closing member can be performed by operating the coupling means from any one of the right and left sides.

BACKGROUND OF THE INVENTION

In a conventional one-side opening type filing apparatus, generally, a finger hook is provided for an accompanying plate which is pivotally attached to the side plate of a base plate through a spring and the accompanying plate is opened against the spring by hooking the finger to the finger hook. As an improved filing apparatus of such a one-side opening type filing apparatus in which the opening/closing member can be opened from any one of the right and left directions and the sheets can be filed and removed, there is a both-side opening type filing apparatus disclosed in Japanese Utility Model Registration Application No. 62-123979 laid open on Aug. 6, 1987. The above filing apparatus of the both-side opening type comprises: an attaching member in which coupling axial pipes are respectively provided at front and back positions of right and left side edges of a rectangular base plate; a pair of right and left hollow opening/closing members in which filing rods having a spike shape and a tubular shape which can be pierced each other are respectively attached at the front and back positions of the inner surface and axial pipes which are respectively coupled with the above axial pipes are provided along the lower edges; and coupling means arranged in the opening/closing members, wherein the coupling means is constructed by operating plates which are slidable in the front and back directions, a spring for always elastically pressing the operating plates in either one of the front and back directions, a pair of front and back coupling rods which are retained to the operating plates, and a locking member to lock the operative state of the operating plates. With the above construction, in the inoperative state, the pair of front and back coupling rods are set into the coupling state in which they are projected from the axial pipes of the opening/closing members into the axial pipes of the attaching member by the pressing force of the spring. When either one of the right and left operating plates is pressed and slided by the finger against the spring in such a coupling state, the coupling rods of retained to such an operating plate are escaped from the axial pipes of the attaching member, thereby disconnecting the axial pipes. The operating state is locked by the locking member. The other opening/closing member rotates to the attaching member and the above disconnected opening/closing member is away from the attaching member, thereby enabling the filing operation of the sheets or the like to be performed. According to the both-side opening type filing apparatus with the conventional construction as mentioned above, the filing operation of the sheets or the like can be performed by releasing the coupling state of the opening/closing members from any one of the right and left directions and it is convenient to use. However, since the operating plates are provided on the opening/closing member side, when the operating plate is pressed by the finger against the spring in order to remove the opening/closing member from the attaching member, the finger pressing force acts in a direction such as to restrict the operation of the opening/closing member which intends to be away from the attaching member, so that there is an inconvenience such that the operating efficiency of the opening/closing member is lost. Further, the cover plate has a distinction regarding the top and bottom from a viewpoint of the display of an index and a title. In the case of releasing the coupling state of the opening/closing members, it is most preferable to execute such a releasing operation on this side of the user. However, in the case of the foregoing construction, since the operating direction to release the coupling state of the opening/closing members is constant, in the case of attaching the filing apparatus to the cover plate, it is necessary to make the top/bottom directions of the cover plate coincident with the operating direction of the filing apparatus. Thus, there is a drawback such that the operating efficiency when the filing apparatus is attached to the cover plate is lost.

SUMMARY OF THE INVENTION

It is an object of the invention to provide a filing apparatus of the both-side opening type in which an operating member provided heretofore on the side of an opening/closing member is attached to the attaching member side, thereby improving the operating efficiency of the opening/closing member and enabling the operating member to be operated from any one of the front and back directions of the opening/closing member, so that an attaching work of the filing apparatus to a front cover is made easy. More practically speaking, the operating member can be always operated at the position on this side irrespective of the filing direction of the sheets and the top/bottom directions of the cover plate.

According to the first embodiment of the invention, a filing apparatus comprises: an attaching member in which a pair of front and back axial pipes and retaining members are respectively provided at the right and left side edges of a base plate; a pair of right and left opening/closing members in which filing rods which can be pierced each other are mounted on the inner surfaces and axial pipes which are coupled to those axial pipes are provided in the lower portions; a pair of operating rods which are relatively moved in the front/back directions by a facing direction interlocking mechanism and function as a pair of coupling mechanisms which are symmetrically arranged at the right and left positions on the base plate and operate the coupling states between the pair of right and left opening/closing members and the attaching member; an elastic pressing member for always elastically pressing the pair of operating rods in the contactless direction; a pair of front and back operating members which are respectively retained to the pair of operating rods and are pierced into the axial pipes of the attaching member and the axial pipes of the opening/closing members at the inoperative positions to thereby rotatably couple the axial pipes and enter the axial pipes of the attaching member and release the coupling with the axial pipes of the opening/closing members when the operating members are operated against the elastic pressing member; and a locking member which is provided for either one of the operating rods and is retained to the retaining members and restricts the relative movement of the operating rods when the coupling of the axial pipes is released and which acts on the axial pipes of the opening/closing members and releases the retaining with the retaining members to thereby allow the relative movement of the operating rods when the axial pipes of the attaching member coincide with the axial pipes of the opening/-closing members. With the above construction, when the operating members are pulled in the direction on this side at the position on this side of either one of the pair of right and left opening/closing members from the inoperative position where the pair of right and left opening/closing members stand so as to face each other, the pair of operating rods are relatively moved in such a direction as to be away from each other. Further, the operating members at the front and back positions are removed from the axial pipes of the opening/closing members and enter the axial pipes of the attaching member, so that one of the opening/closing members is removed away from the attaching member. Thus, when the cover plate is opened, the opening/closing members which are in the coupling state because the weight of the fallen sheets acts on the opening/closing members are rotated outwardly. Due to this, even when the coupling state is released, the opening/closing members automatically float up. On the other hand, since the pair of operating rods relatively move in such a direction as to be away from each other, the locking member provided for one of the operating rods is retained to the retaining member of the base plate, so that the non-coupling state between the attaching member and one opening/closing member is held. The above operation is also similarly executed when any one of the other operating members is operated in the direction on this side.

According to the second embodiment, by providing the operating members at the left, right, front, and back positions of the attaching member and by pressing either one of the operating members, the pair of operating rods relatively move in the contactless direction against the pressing force by the facing direction interlocking mechanism. The operating rods provided for the front and back operating members are removed away from the axial pipes of the opening/closing members and enter the axial pipes of the attaching member, so that one opening/closing member is removed away from the attaching member. On the other hand, since the pair of operating rods relatively move in such a direction as to approach each other, the retaining lever provided for one of the operating rods is retained to a guide rib of a cover. Therefore, the non-coupling state between the attaching member and one opening/closing member is held. The above operation is also similarly performed when any one of the other operating members is pressed and operated. Further, according to a modification of the second embodiment, the attaching member is divided into halves by a symmetrical line with respect to the right and left positions, thereby enabling the attaching member to be commonly used in the case where widths of rear side cover of the cover plate differ.

According to the third embodiment, the operating members are constructed in a manner such that the operating member for pressing is integratedly provided in one edge portion of one operating rod and the operating member for pulling is integratedly provided in the other edge portion, the operating members for pressing are arranged in one edge portion of the attaching member, the operating members for pulling are arranged in the other edge portion, and either one of the right and left pressing operating members locating on this side is pressed, so that one operating rod slides against the pressing force and the front and back coupling rods are removed away from the axial pipes of the opening/closing members and enter the axial pipes of the attaching member. Consequently, one opening/closing member is removed away from the attaching member. Since one operating rod slides, the retaining lever provided for the operating rod is retained to the guide rib of the cover, so that the non-coupling state between the attaching member and one opening/closing member is held. Even in the case where either one of the right and left operating members for pulling is pulled and operated, one operating rod slides in the pulling direction, so that the pulling operating member functions in a manner similar to the case where the operating member for pressing is depressed. According to another modification of the third embodiment, the pressing operating member is arranged in one edge portion of the attaching member, the pulling operating member is arranged in the other edge portion, the pulling operating member is arranged in one of the other edge portions of the attaching member, and the pressing operating member is arranged in the other one of the edge portions. Even in any one of the above embodiments, since the operating members are located at the front, back, right, and left positions of the attaching member, there is an effect such that the work to attach to the cover plate can be executed without considering the direction of the attaching member.

According to the fourth embodiment, a filing apparatus comprises: an attaching member in which a pair of front and back axial pipes are provided at the right and left side edges of a base plate; a pair of right and left hollow flat-shaped opening/closing members in which filing rods which can pierce each other are projected on the inner surfaces and a pair of front and back axial pipes which are coupled with the axial pipes are provided in the lower portions; coupling means which are arranged in the pair of right and left opening/closing members, respectively, and are constructed in a manner such that coupling rods are respectively provided for a pair of front and back operating plates coupled by a facing direction interlocking mechanism, when the pair of operating plates move in one of the facing directions, the coupling rods are respectively projected from the pair of front and back axial pipes of the opening/closing members into the pair of front and back axial pipes of the attaching member to thereby rotatably couple them, and when the pair of front and back operating plates move in the other one of the facing directions, the coupling rods respectively enter the pair of front and back axial pipes of the opening/closing members from the pair of front and back axial pipes of the attaching member to thereby release the coupling state of them; holding means which are arranged in the pair of right and left opening/closing members and is constructed in a manner such that when the coupling means move to the non-coupling positions, such a state is held, and when the opening/closing members reach the coupling positions of the attaching member, the above holding state is released by acting on the axial pipes of the attaching member; and operating members which are respectively arranged at front and back positions on the right and left sides of the attaching member and operate the operating plates of the coupling means from the coupling positions to the non-coupling positions. At this time, in the case where the operating plates are provided with elastic members which are come into pressure contact with the axial pipes of the attaching member in the non-coupling state of the coupling means and which apply repulsive elastic pressures between the attaching member and the opening/closing members, the operating members are depressed and, when the coupling state between the attaching member and the opening/closing members is released, the opening/closing members automatically float up from the attaching member by the applying force of the holding member and can be easily removed from the attaching member.

In any of the first to fourth embodiments, when the coupling state of one opening/closing member is released, in the case where the sheets are not filed, the filing rods outwardly rotate and stand at the coupling position of the other opening/closing member coupled to the attaching member by the operation by the hand due to the weight of the filed sheets. In this state, the piercing states of the filing rods are released and the sheets or the like are filed to one opening/closing member. The filing rods are again mutually pierced and the sheets or the like are filed to the filing rods. One opening/closing member in the non-coupling state is then returned to the original coupling position by the manual operation. When the positions of the axial pipes of the opening/closing member coincide with the coupling positions with the axial pipes of the attaching member, the holding state of the holding means is automatically released by the axial pipes. The coupling means is returned by the elastic applying force and the axial pipes of the attaching member and the axial pipes of one opening/closing member are again coupled by the coupling rods.

As mentioned above, according to the invention, since the operating members to operate the coupling mechanism are provided on the attaching member side, the filing operation can be smoothly executed without exerting any trouble to the opening/closing operation of the opening/closing member. On the other hand, since the operating members are arranged at the front, back, right, and left positions of the attaching member, the operating member can be always operated at the position on this side and the filing work can be executed irrespective of the filing direction of the sheets or the handling of the user, that is, independently of the normal standing filing or handstanding filing. It is extremely convenient to handle. The attaching direction to the cover plate is not restricted. Therefore, the attaching work to the cover plate can be also easily performed. Further, according to the first, second, and fourth embodiments, since the attaching relations of the opening/closing members to the attaching member are made symmetrical with respect to the oblique direction of the attaching member, there are effects such that the pair of right and left opening/closing members can be used from any one of the right and left directions and the same parts can be commonly used and the manufacturing costs can be reduced.

DETAILED DESCRIPTION OF THE INVENTION

Figure 1:
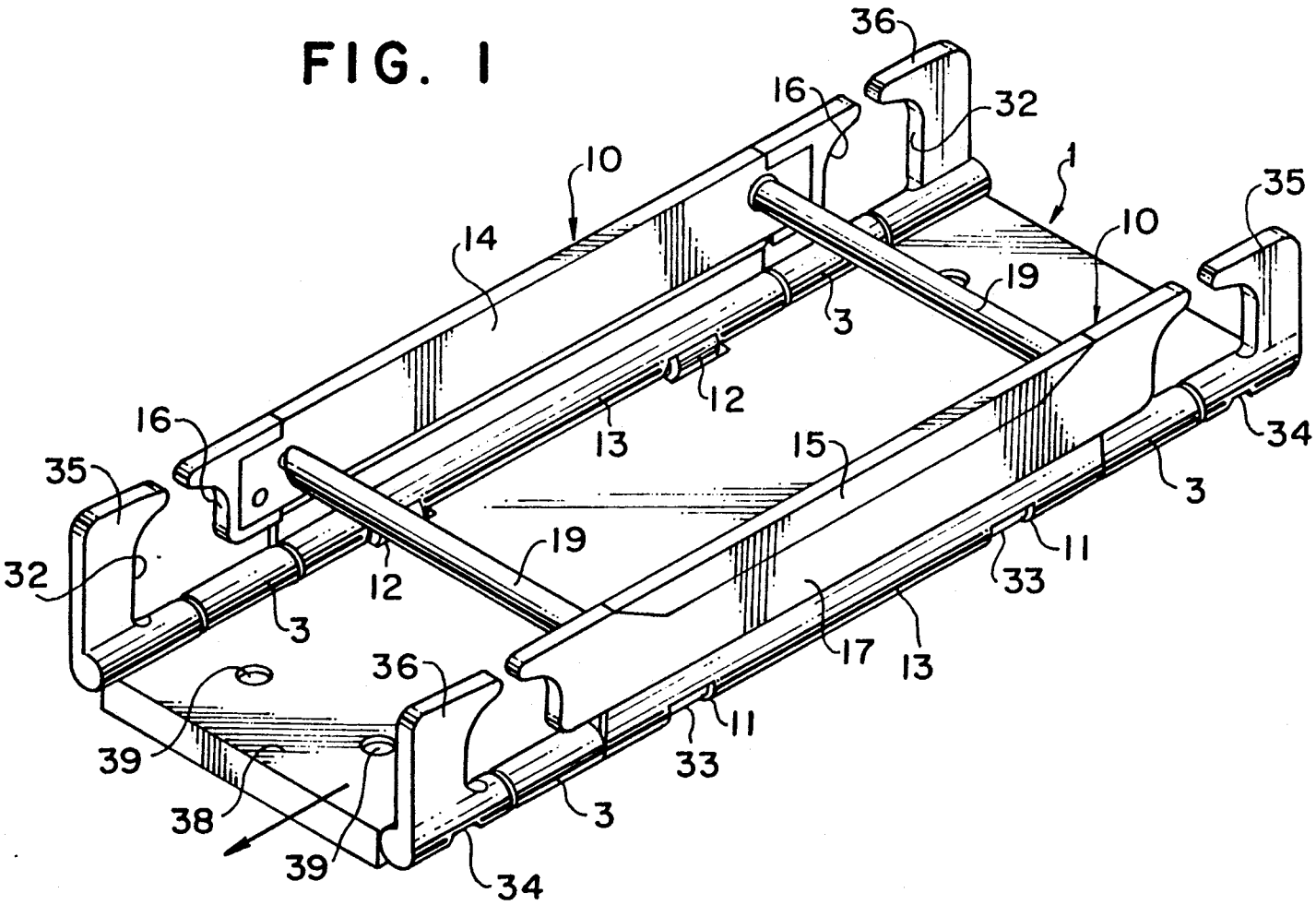
FIG. 1 is a whole perspective view of the first embodiment of the invention.
Figure 2:
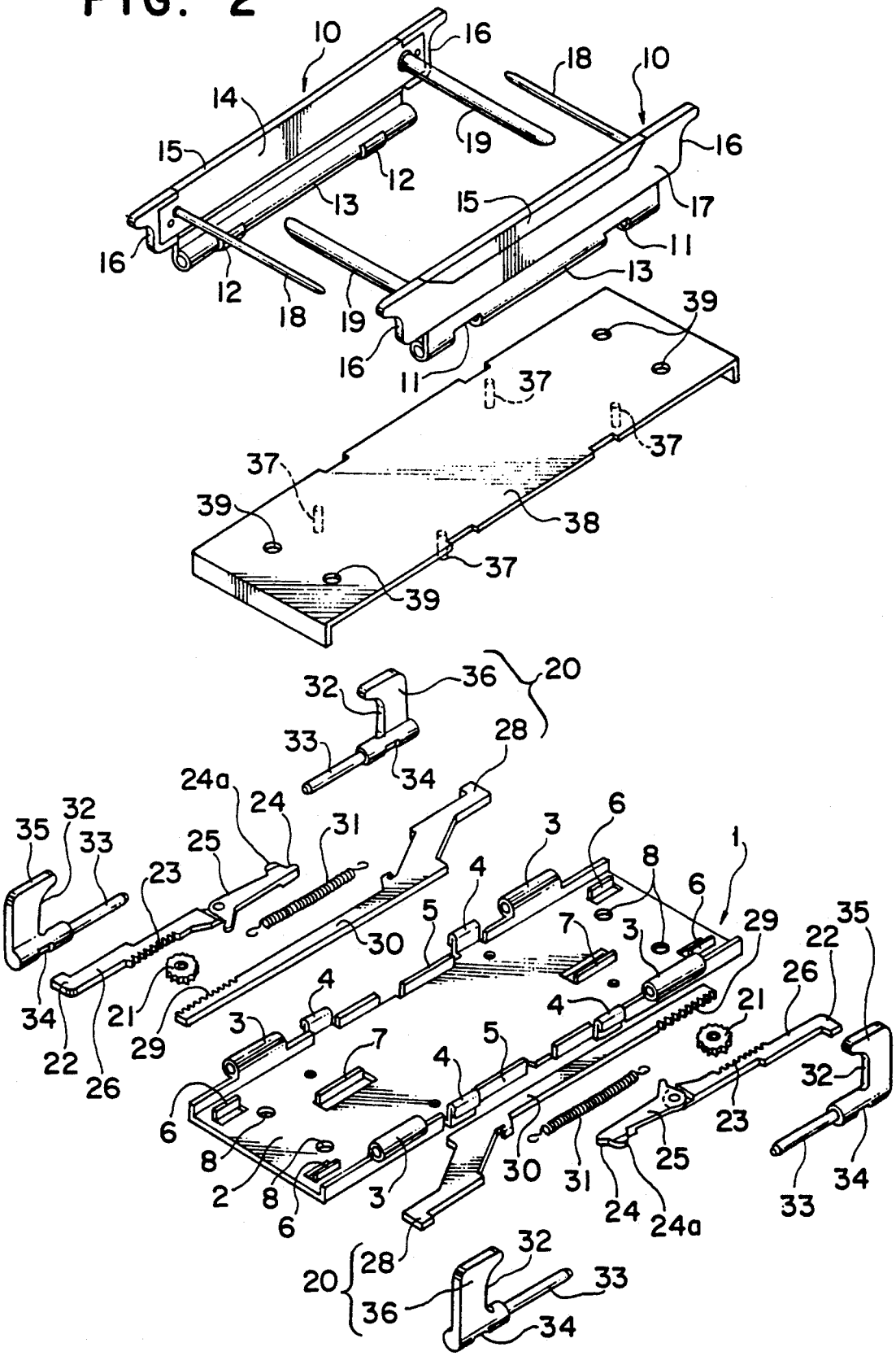
FIG. 2 is an exploded perspective view of the first embodiment of the invention.
Figure 3:
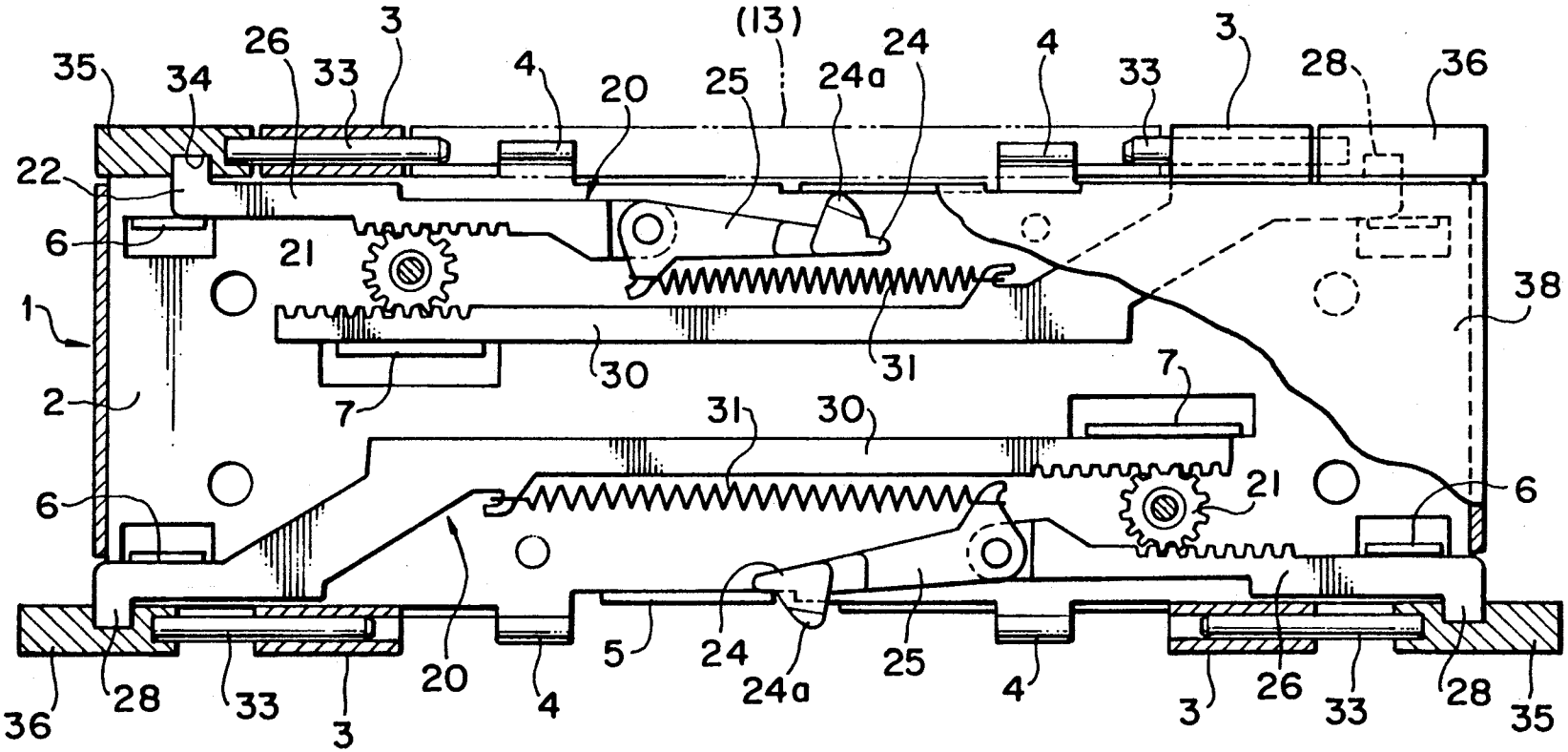
FIG. 3 is a plan view of the first embodiment of the invention with a part cut away and with a part omitted.

The first embodiment of the invention will be described with reference to FIGS. 1 to 5. Reference numeral 1 denotes an attaching member which is constructed in the following manner. A pair of front and back axial pipes 3 for coupling, receiving members 4 which stand up at inner positions of the axial pipes 3 with a desired interval, and retaining members 5 which rise so as to be located at the positions of the receiving members 4 are respectively provided at the right and left longitudinal side edges of a rectangular base plate 2 so as to be symmetrical with respect to-the right/left directions and the front/back directions. Guide members 6 and 7 are formed at the front and back positions near the right and left side edges of the base plate 2 and at the central position by cutting and bending vertically upwardly, respectively. Attaching holes 8 are formed in the base plate 2 so as to fix the base plate 2 to, for instance, the inner surface of the rear side cover of the cover plates. Reference numeral 10 denotes a pair of right and left opening/closing members having lengths such that the opening members 10 extend in the front-/back directions in the lower portions and enter between the pair of front and back axial pipes 3 of the attaching member 1. U-shaped bending portions 15 which outwardly face are formed at the upper edges of side plates 14 which are made of metal and have axial pipes 13. The axial pipes 13 have concave portions 11 into which the receiving members 4 are inserted at the front and back positions and inducing members 12 which are provided at the inner surface positions of the concave portions 11 and whose lower edges are come into pressure contact with the inner surfaces of the receiving members 4, thereby inducing the opening/-closing members 10 inwardly. An auxiliary plate 17 made of a synthetic resin is overlaid to the outer surface of the side plate 14. An upper edge of the auxiliary plate 17 is sandwiched by the bending portion 15, front/back edges are projected from the side plate 14, and a downward notch portion 16 is formed in an edge surface of the plate 17. As shown in FIG. 2, spike-shaped filing rods 18 and tubular filing rods 19 which can pierce each other so that the right and left opening/closing members 10 can be commonly used are respectively projected on the inner surfaces of the opening/closing members 10. Reference numeral 20 denotes a pair of right and left coupling mechanisms which are arranged at the right and left positions on the surface of the base plate 2 so as to be symmetrical with respect to the front-/back directions, respectively. Each of the coupling mechanisms 20 comprises: a pinion 21; one operating rod 26; another operating rod 30; a spring 31; and a pair of front/back operating members 35 and 36 made of a synthetic resin. The pinion 21 is rotatably pivotally attached onto the surface of the base plate 2. A retaining claw 22 is provided at an outer edge. A rack 23 which is come into engagement with the pinion 21 is formed on a rear side surface. A locking member 25 having at a front edge a retaining portion 24 which is retained to the retaining member 5 and an inclined surface **24*a* is rotatably pivotally attached to an inner edge. The operating rod 26 is guided between the inner surface of one axial pipe 3 and one guide member 6 which face the axial pipe 3 and slides on the base plate 2 in the front-/back directions. The other operating rod 30 has a retaining claw 28 at the outer edge and a rack 29 which is come into engagement with the pinion 21 at the inner edge, respectively, and extends in the front/back directions of the base plate 2. The operating rod 30 is slided and guided by the inner surface of the other axial pipe 3, the other guide member 6 which faces the axial pipe 3, and the guide member 7 at the central position. The spring 31 is disposed between the locking member 25 of one operating rod 26 and the other operating rod 30 and always elastically presses both of the operating rods 26 and 30 in the contactless direction and applies an outward rotational force to the locking member 25. The operating members 35 and 36 have finger hooking notch portions 32 on the inner surfaces and coupling shafts 33 are horizontally projected in the lower portions. In the inoperative state, the coupling shafts 33 project from the axial pipes 3 and are communicated with the axial pipes 13 of the opening/closing members 10 to thereby rotatably couple the axial pipes 3 and 13. In the operative state, the coupling shafts 33 are escaped from the axial pipes 13 and release the coupling state of the axial pipes 3 and 13. Retaining grooves 34 which are respectively retained to the retaining claws 22 and 28 are formed in the circumferential direction. The coupling mechanisms 20 constructed as mentioned above are arranged at the right and left positions on the base plate 2 so as to be symmetrical with respect to the diagonal line direction. The pair of right and left opening/-closing members can be used in any one of the right and left directions. By fixedly attaching a cover 38 onto the base plate 2 by projecting shafts 37, the coupling mechanisms 20 are hidden between the cover 38 and the base plate 2. Reference numeral 39 denotes attaching holes. In the inoperative state of FIG. 5 in which the pair of right and left opening/closing members 10 stand up and face each other to thereby file the sheets, as shown at the position of the upper half portion in FIG. 3, since the pair of front and back operating members 35 and 36 are retained to the pair of front and back operating rods 26 and 30, respectively, so that they are elastically pressed by the spring 31 in the contact direction with each other. In the above state, the pair of front and back axial pipes 3 are coupled with the axial pipes 13 of the opening/closing members 10 by the coupling shafts 33 and the retaining portion 24 is come into pressure contact with the inner surface of the retaining member 5. Further, since the pressure contact member 12 is in pressure contact with the receiving member 4, a repulsive force is held between them. In the above inoperative state, for instance, when the operating member 36 located on this side of either one of the right and left opening/closing members 10 is pulled in the direction shown by an arrow in FIG. 1 by hooking the finger into the notch portion 32, as shown at the position of the lower half portion in FIG. 3, the pair of operating rods 26 and 30 relatively move in the direction so as to be away from each other together with the operating members 35 and 36 against the force of the spring 31 by the engagement between the pinion 21 and the racks 23 and 29 provided for the pair of operating rods 26 and 30 through one operating rod 26 retained to the operating member 36. The coupling shafts 33 at the front and back positions are escaped from the axial pipes 13 of one opening/closing member 10 and enter the axial pipes 3 of the base plate 2, so that the coupling state between the axial pipes 3 and 13 is released. On the other hand, in association with the slide motion of the operating rod 26, the retaining portion 24 is removed from the inner surface of the retaining member 5 and retains to the edge of the retaining member 5. The inserting state of the coupling shafts 33 into the axial pipes 3** is held. The above operation is also executed in a manner similar to the case where any one of the other operating members is operated by the fingers.

Figure 5:
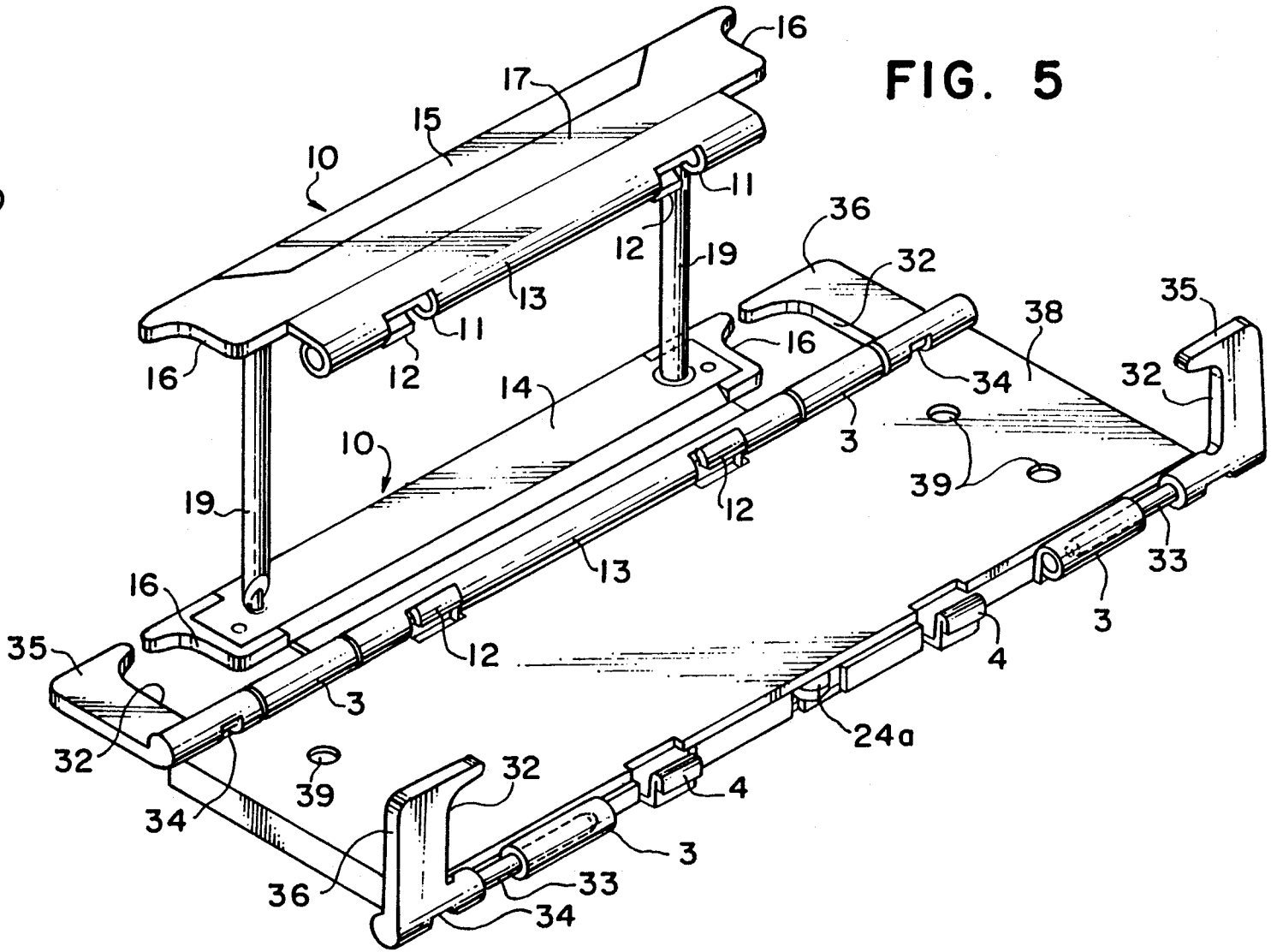
FIG. 5 is a perspective view of a state in which one of the opening/closing members in the first embodiment of the invention is opened.
Figure 4:
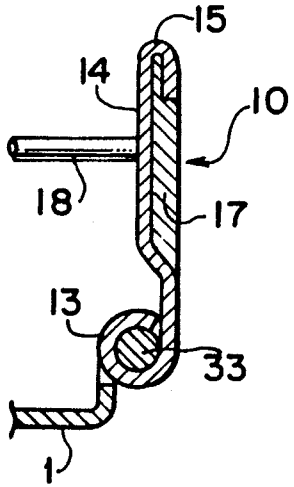
FIG. 4 is a vertical sectional view of an opening/closing member of the first embodiment of the invention.
Figure 6:
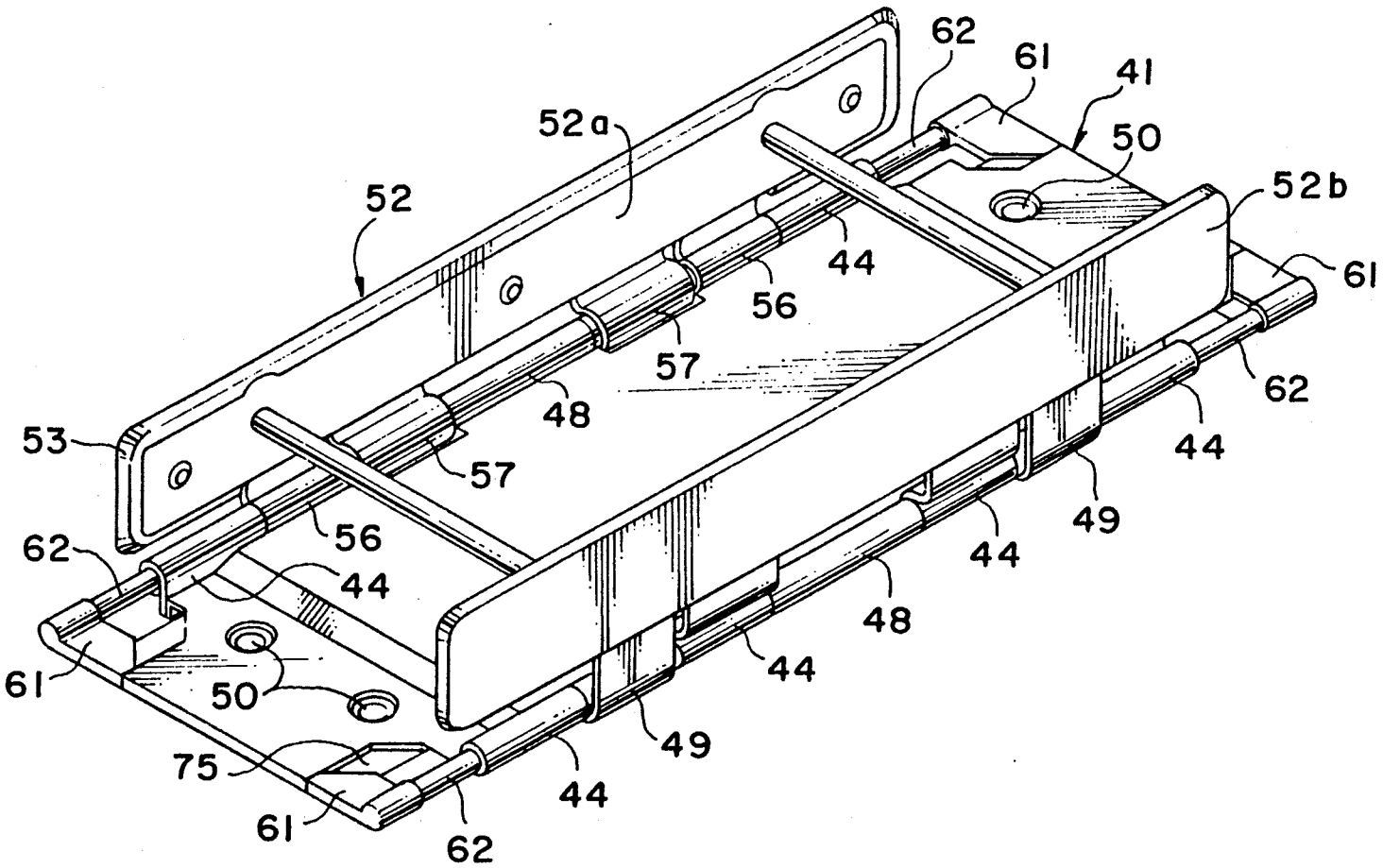
FIG. 6 is a whole perspective view of the second embodiment of the invention.

Subsequently, the opening/closing member 10 automatically rotates outwardly by using the coupling shafts 33 locating at the front and back positions as fulcrums due to the weight of the filed sheets which is applied to the inner surface of the other opening/closing member 10 in the coupling state. As shown in FIG. 5, the filing rods 18 and 19 are allowed to stand up. After that, the filing rods 18 and 19 of one opening/closing member 10 in the non-coupling state with the attaching member 1 are pulled out of the filing rods 18 and 19 of the other opening/closing member 10 in the coupling state with the attaching member 1. The filing operation of the document is executed from the spike-shaped filing rod 18 and the document is finally filed to the tubular filing rods 19. After that, one opening/closing member 10 in the non-coupling state is rotated and is allowed to stand up at the original position and the axial pipes 13 are inserted between the axial pipes 3 of the attaching member 1. At this time, the inducing members 12 are come into contact with the outside of the corresponding receiving members 4, so that the opening/closing member 10 is attracted inwardly. Thus, the lower surface of the axial pipe 13 is come into contact with the inclined surface 24*a*. The retaining portion 24 is inclined inwardly against the spring 31. Thus, since the engagement between the retaining portion 24 and the retaining member 5 is released, the pair of operating rods 26 and 30 and the operating members 35 and 36 slide in the contactless direction by the spring 31. The coupling shafts 33 are again projected from the axial pipes 3 and are coupled with the axial pipes 13 and a coupling state is returned to the state of FIG. 1.

In the above description, when the opening/closing member 10 in the non-coupling state is outwardly inclined and fallen, the operating members 35 and 36 locating at the front and back positions of the opening member 10 are held in the standing state. However, when the opening/closing member 10 is inclined and fallen outwardly, the document filed to the filing rods 19 is also inclined and fallen in the same direction, so that the operating members 35 and 36 are automatically inclined and fallen in association with the falling motion of the document. The fallen operating members 35 and 36 automatically stand up when the front cover or back cover of the cover plate in which the attaching member 1 is fixed to the inner surface of the rear portion is closed. Since the operating portions are provided so as to be symmetrical with respect to the right, left, front, and back directions, the pair of right and left opening/-closing members can be also operated in any of the right and left directions.

The second embodiment of the invention will be further described with reference to FIGS. 6 to 9.

An attaching member 41 comprises: a rectangular base plate 42 made of a metal; and a rectangular cover 43 made of a synthetic resin which is attached so as to cover the upper surface of the base plate 42. The base plate 42 is provided with four axial pipes 44 at the symmetrical positions of both sides in the longitudinal direction, respectively. Attaching holes 45 to attach the base plate 42 to the cover plate are formed at both edge positions in the longitudinal direction of the base plate 42, caulking holes 46 to attach the cover 43 are formed at the central position and both edge positions, and stop members 47 are provided at diagonal positions of both edges.

Cover members 48 and guide ribs 49 are provided on both sides in the longitudinal direction of the cover 43. The cover member 48 is upwardly curved like a convex shape and is located in the central portion of each side in the longitudinal direction of the cover 43 and covers the exposed portion of a coupling rod 65, which will be explained hereinafter, from the upper position. The guide ribs 49 are located at the front and back positions and are bent downwardly. Recess portions 50 with holes which are fitted into the attaching holes 45 are formed at the positions corresponding to the attaching holes 45 of the base plate 42. Pillar-shaped projecting shafts 51 to hold an interval are respectively formed on the lower surfaces corresponding to the caulking holes 46. The cover 43 is overlaid onto the upper surface of the base plate 42. The lower edges of the projecting shafts 51 are caulked to the caulking holes 46, so that the attaching member 41 having a desired gap between the base plate 42 and the cover 43 is constructed.

Figure 7:
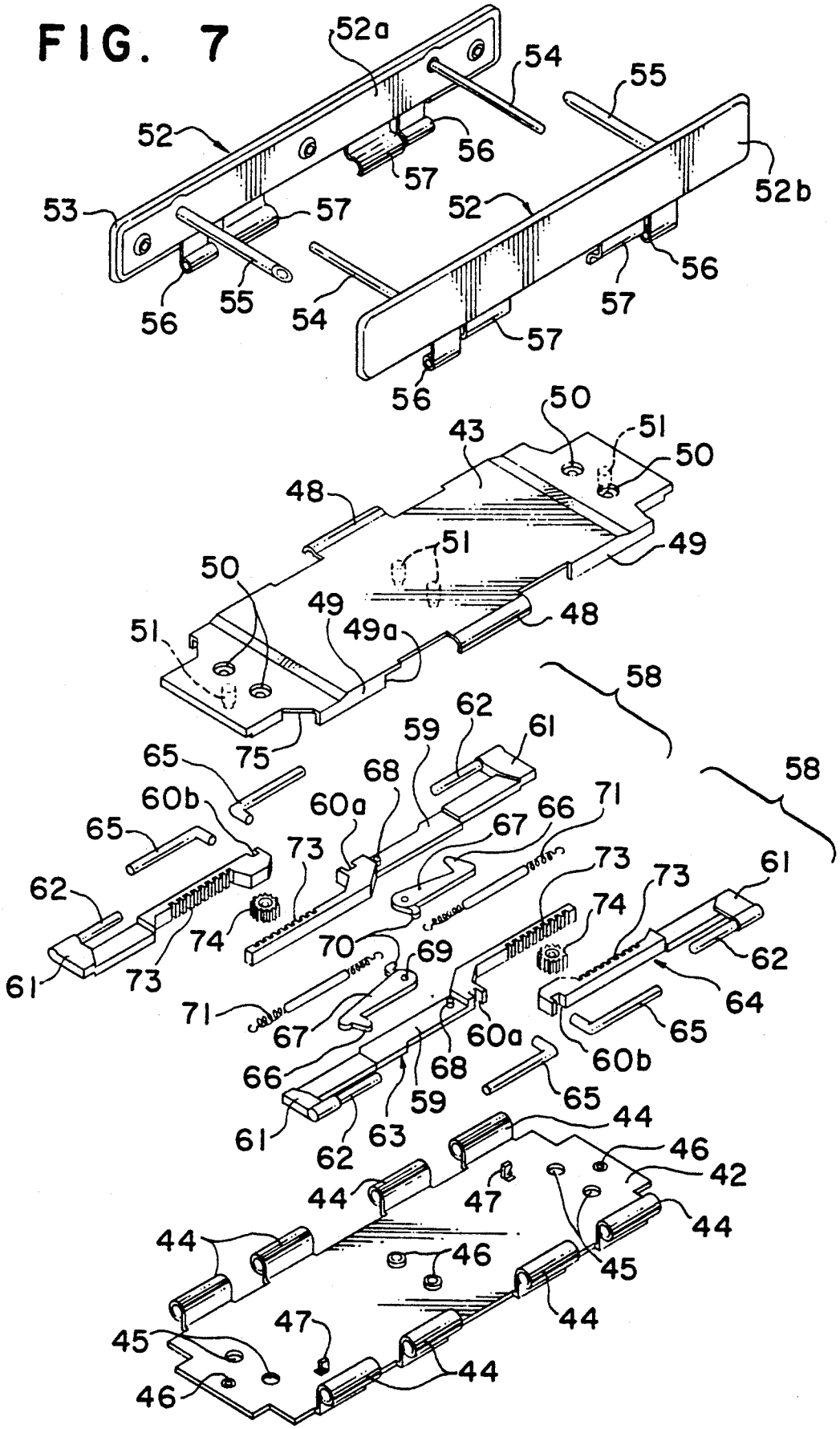
FIG. 7 is an exploded perspective view of the second embodiment of the invention.

In a pair of right and left opening/closing members 52 which are rotatably coupled to the attaching member 41, a peripheral edge of an inner plate 52*a* made of a metal is fixed by an outer peripheral holding portion 53 of an outer plate 52*b* made of a synthetic resin. As shown in FIG. 7, in both edge portions in the longitudinal direction of the inner plate 52*a*, there is shown a case where a spike-shaped filing rod 54 and a tubular filing rod 55 are respectively planted at the positions of both edge portions in the longitudinal direction of the inner plate 52*a* so that the right and left opening/closing members 52 can be commonly used. At the lower edges of the inner plates 52*a* constructed as mentioned above, a pair of front and back axial pipes 56 which are coupled to the axial pipes 44 of the attaching member and a pair of front and back inducing members 57 are provided. The inducing members 57 are inwardly curved. When the opening/closing members 52 are coupled to the attaching member 41, the inducing members 57 come into slide contact with the outer peripheral surfaces of the axial pipes 44 of the attaching member 41 and are fitted into the axial pipes 44, thereby inwardly inducing one opening/closing member 52.

A pair of right and left relative coupling mechanisms 58 for rotatably coupling the opening/closing members 52 to the attaching member 41 are respectively arranged at the right and left half portion positions in the short width direction in the gap formed between the base plate 42 and the cover 43. The relative coupling mechanism 58 comprises: one operating rod 63; another operating rod 64; a spring 71 to always elastically press the operating rod 63 in one direction; and a pair of front and back coupling rods 65. The operating rod 63 is constructed in the following manner. The rod 63 has a pinion 74 which is rotatably pivotally attached onto the surface of the base plate 42, a rack 73 which is come into engagement with the pinion 74 and is formed in one edge portion, and a concave surface 59 which is formed on a part of the upper surface in the longitudinal direction of an elongated member made of a synthetic resin. A notch portion 60*a* is formed in almost the central portion in the longitudinal direction of the rod 63. A wide operating member 61 is provided in the other edge portion in the longitudinal direction. In an outside portion, the rod 63 has a guide shaft 62 which is slidably fitted into the axial pipe 44 locating in one edge portion of the attaching base plate 42. A notch portion 60*b* and a rack 73 which is come into engagement with a pinion 74 are formed in one edge portion of the rod 64. The rod 64 has the operating member 61 and the guide shaft 62 in the other edge portion. The coupling rods 65 are bent into L-character shapes and their bent edges are respectively come into engagement with the notch portions 60*a* and 60*b*.

A holding mechanism to hold the non-coupling state of the coupling mechanism 58 comprises: a hole 69 whose base portion is provided in the edge portion through a shaft member 68 at the concave surface 59 of the operating rod 63; a holding lever 67 which is horizontally rotatably axially supported and in which a claw member 66 is projected in the free edge portion; and the spring 71 to always apply an outward rotation to the holding lever 67. In the embodiment, there is shown the case where the spring 71 is disposed between a stop member 70 provided in the base portion of the holding lever 67 and the stop member 47 provided on the base plate 42, thereby commonly using-the spring 71 in the coupling mechanism 58 and the spring 71 in the holding mechanism.

The claw member 66 of the holding lever 67 is come into pressure contact with the inner surface of the guide rib 49 provided for the cover 43 by the rotating force of the spring 71 in the coupling state of the attaching member 41 and the opening/closing member 52. When the operating rods 63 and 64 relatively move against the pressing force of the spring 71 and the coupling state of the attaching member 41 and the opening/closing member 52 is released, the claw member 66 is projected outwardly from an inner edge 49*a* of the guide rib 49 and is retained to the inner edge 49*a* of the guide rib 49.

A cut-out portion 75 is provided at the corner position in one edge portion in the longitudinal direction of the attaching member 41. The operating member 61 of the coupling mechanism 58 faces such a corner position so as to be movable in the front and back directions. In the inoperative state of FIG. 6 in which the pair of right and left opening/closing members 52 stand up and face and file the sheets, as shown at the left half portion position in FIG. 9, in a state in which the operating rod 63 is elastically pressed by the spring 71, the front and back coupling rods 65 are projected from the axial pipes 44 of the attaching member 41 into the axial pipes 56 of the opening/closing member 52, so that the attaching member 41 is coupled with the opening/closing member 52. The claw member 66 of the holding lever 67 is come into pressure contact with the inner surface of the guide rib 49 by the rotating force by the spring 71.

When the operating member 61 is pressed against the spring 71 in the inoperative state so as to remove either one of the opening/closing members 52 away from the attaching member 41, the operating rods 63 and 64 relatively move in tile contactless direction. As shown at the right half portion position in FIG. 9, the coupling rod 65 is ejected out from the axial pipes 56 of the opening/closing member 52 and enters the axial pipes 44 of the attaching member 41. The coupling state of the axial pipes 44 and 56 is released. The claw member 66 of the holding lever 67 which is in pressure contact with the inner surface of the guide rib 49 is outwardly projected from the inner edge 49*a* of the guide rib 49 due to the relative movement of the operating rods 63 and 64. The claw member 66 is retained to the inner edge 49*a*. The slide state of the operating rods 63 and 64, namely, the non-coupling state of the coupling mechanisms 58 is held.

Figure 8:
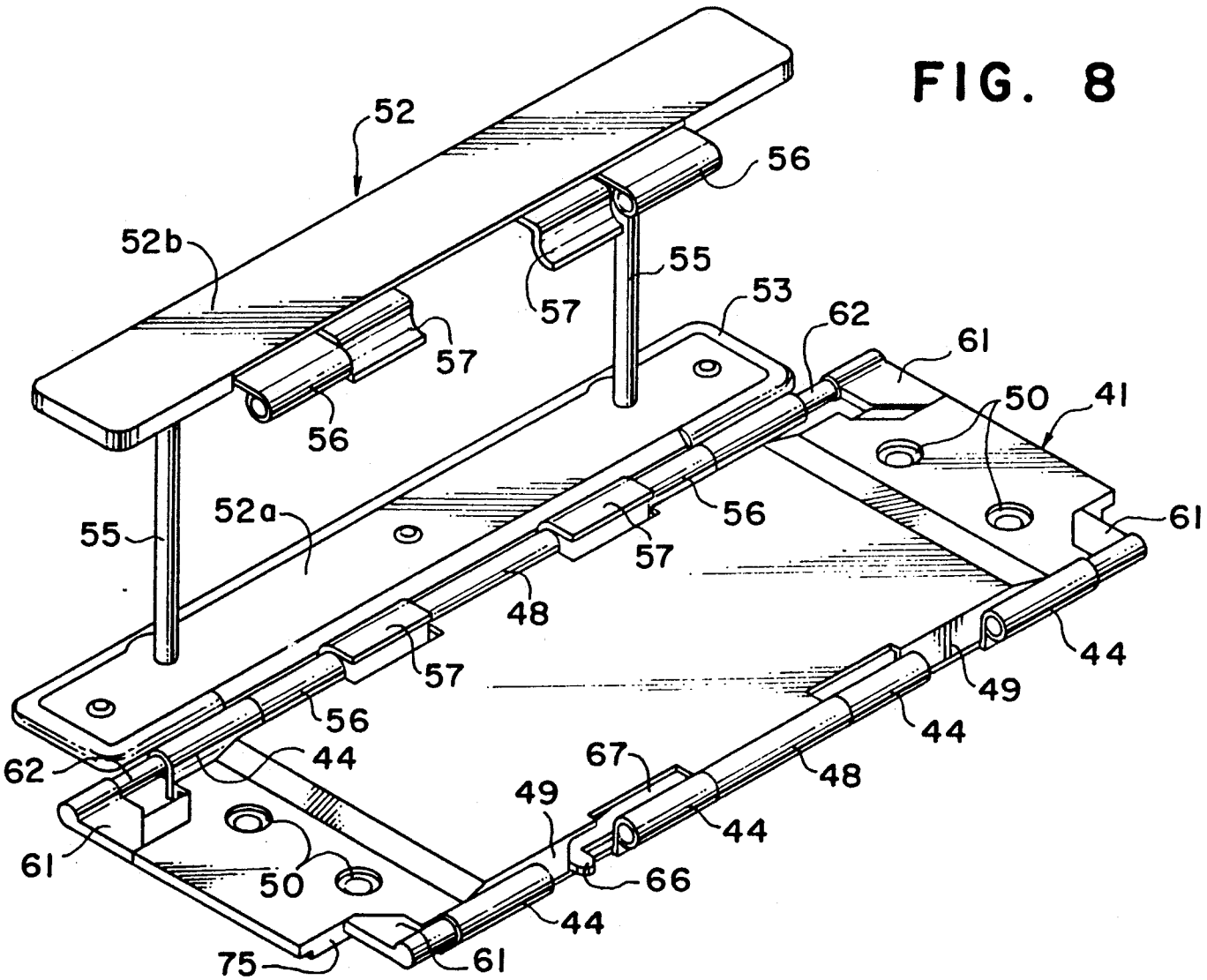
FIG. 8 is a perspective view of a state in which one of opening/closing members in the second embodiment of the invention is opened.
Figure 9:
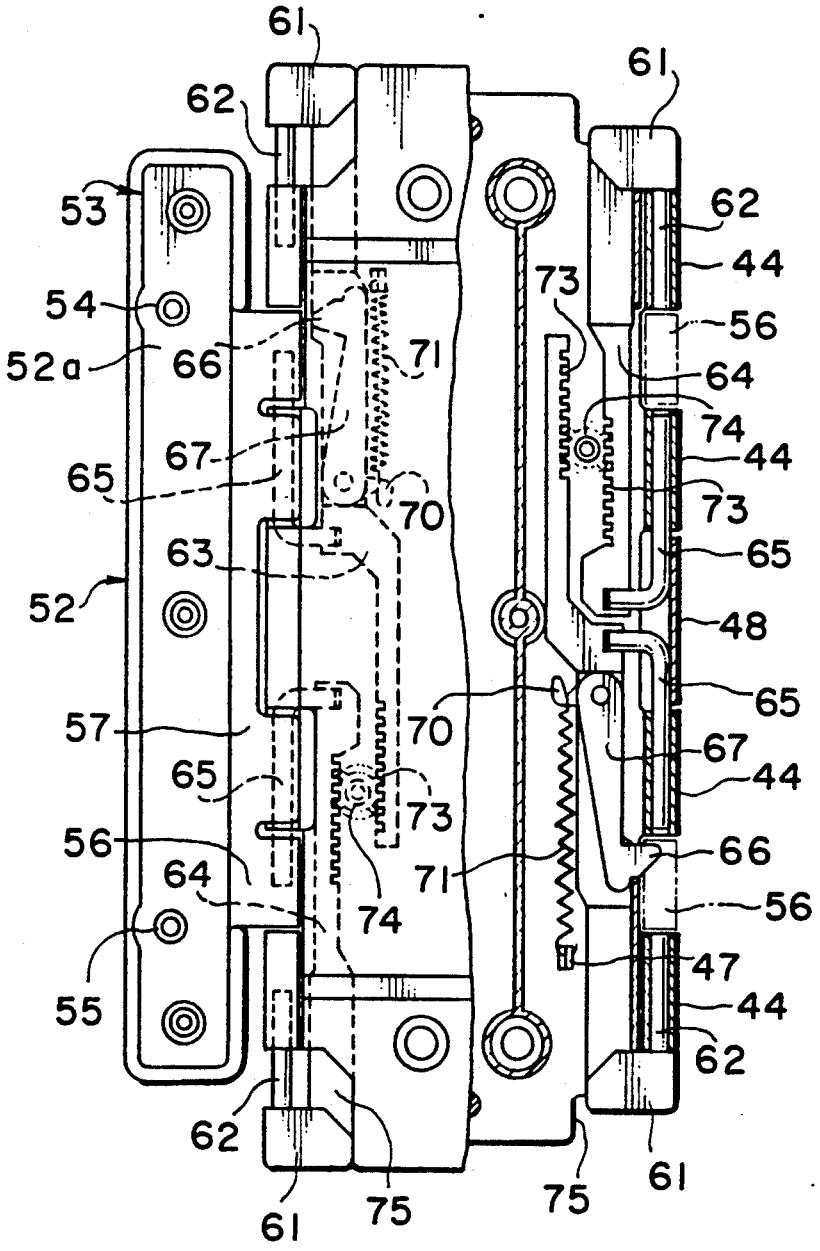
FIG. 9 is a plan view of the second embodiment of the invention with a part cut away and with a part omitted.

When the coupling state of one opening/closing member 52 and the attaching member 41 is released, the other opening/closing member 52 which is rotatably coupled with the attaching member 41 outwardly rotates by the weight of the sheets. The spike-shaped filing rod 54 and the tubular filing rod 55 stand up. The pair of right and left opening/closing members 52 are set into a state in which they face in the vertical direction as shown in FIG. 8.

Therefore, in a manner similar to the above, when one opening/closing member 52 which has been away from the attaching member 41 is removed from the other opening/closing member 52 and the filing rods 54 and 55 are pierced into the filing holes formed in the sheets or the like and one opening/closing member 52 is again coupled to the other opening/closing member 52 and, after that, the other opening/closing member 52 is allowed to stand up and rotate for the attaching member 41, the curved inner surface of tile inducing member 57 is fitted to the outer peripheral surfaces of the axial pipes 44. Thus, one opening/closing member 52 is inwardly attracted and the positions of the axial pipes 56 coincide with the coupling positions with the axial pipes 44 of the attaching member 41.

The axial pipes 56 of one opening/closing member 52 are come into contact with the front edge of the claw member 66 of the holding lever 67 projecting from the side of the attaching member 41. The claw member 66 is inwardly pressed against the spring 71. Thus, the engaging state between the inner edge 49*a* of the guide rib 49 and the claw member 66 is released. The operating rods 63 and 64 are automatically returned to the inoperative position by the elastic pressing force of the spring 71. The coupling rod 65 couples the axial pipes 44 and 56. The pair of right and left opening/ closing members 52 again face in a standing state.

Figure 10:
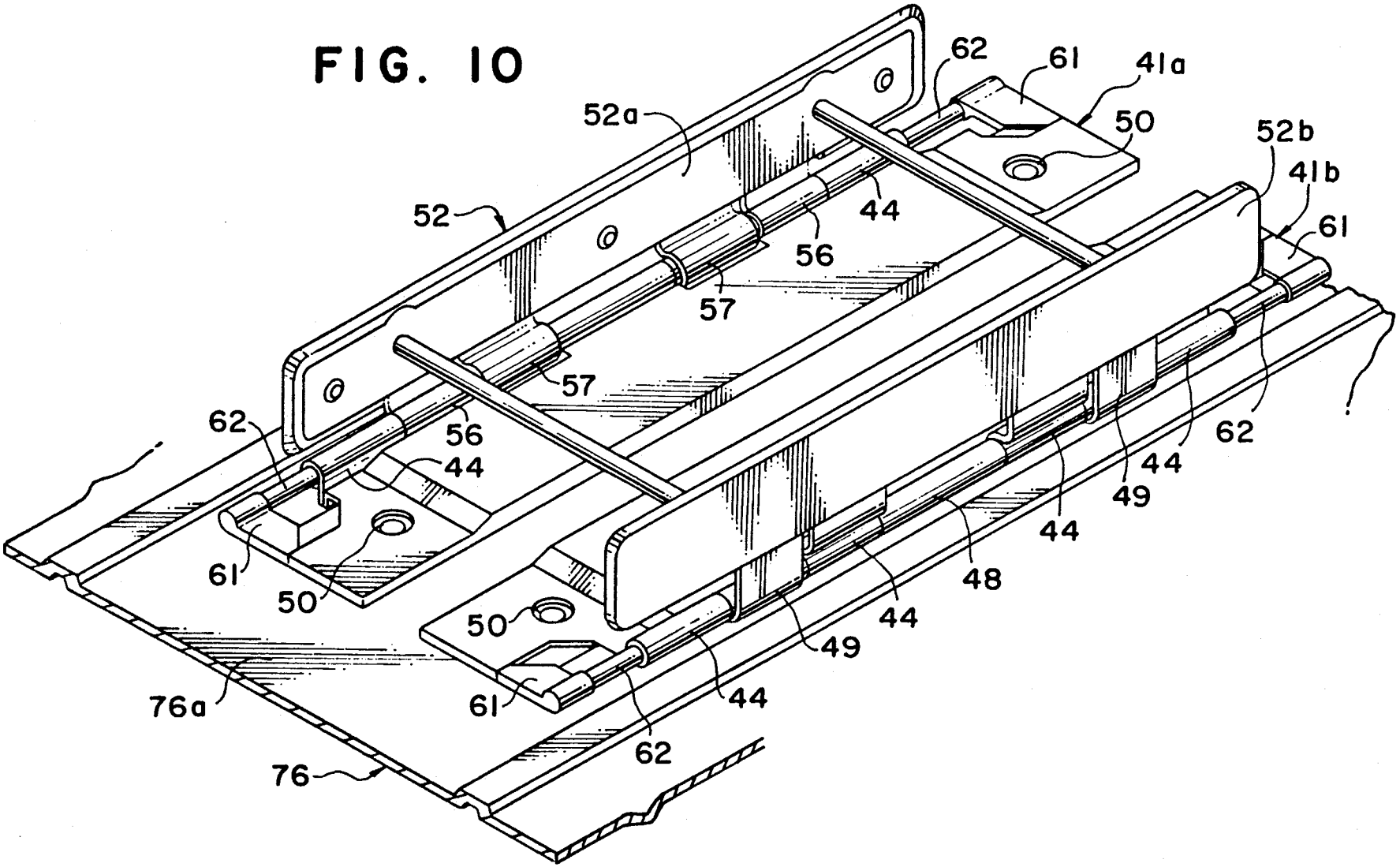
FIG. 10 is a whole perspective view in a modification of the second embodiment of the invention.
Figure 11:
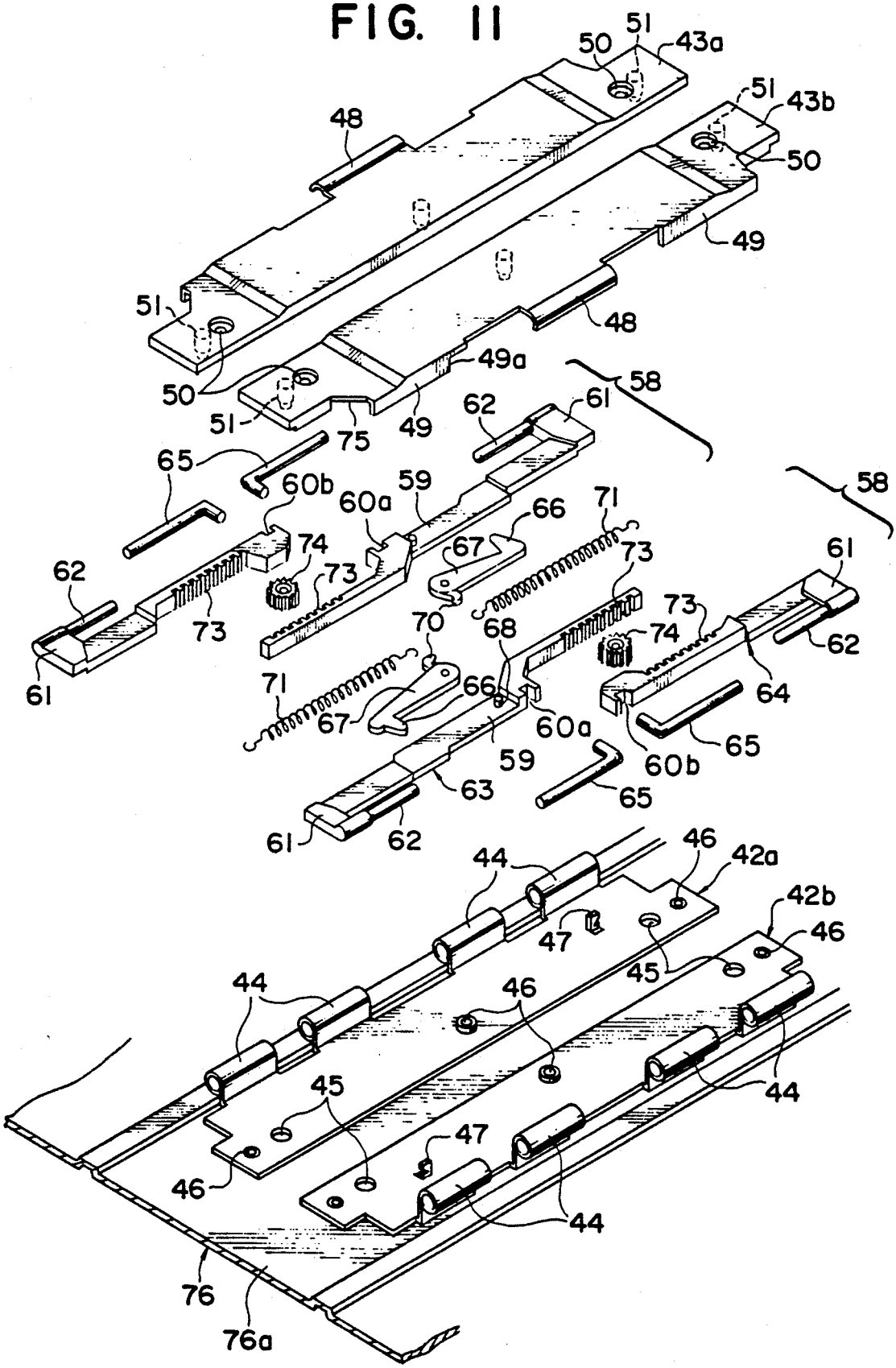
FIG. 11 is a perspective view of a state in which an opening/closing member in the modification of the second embodiment of the invention is opened.
Figure 12:
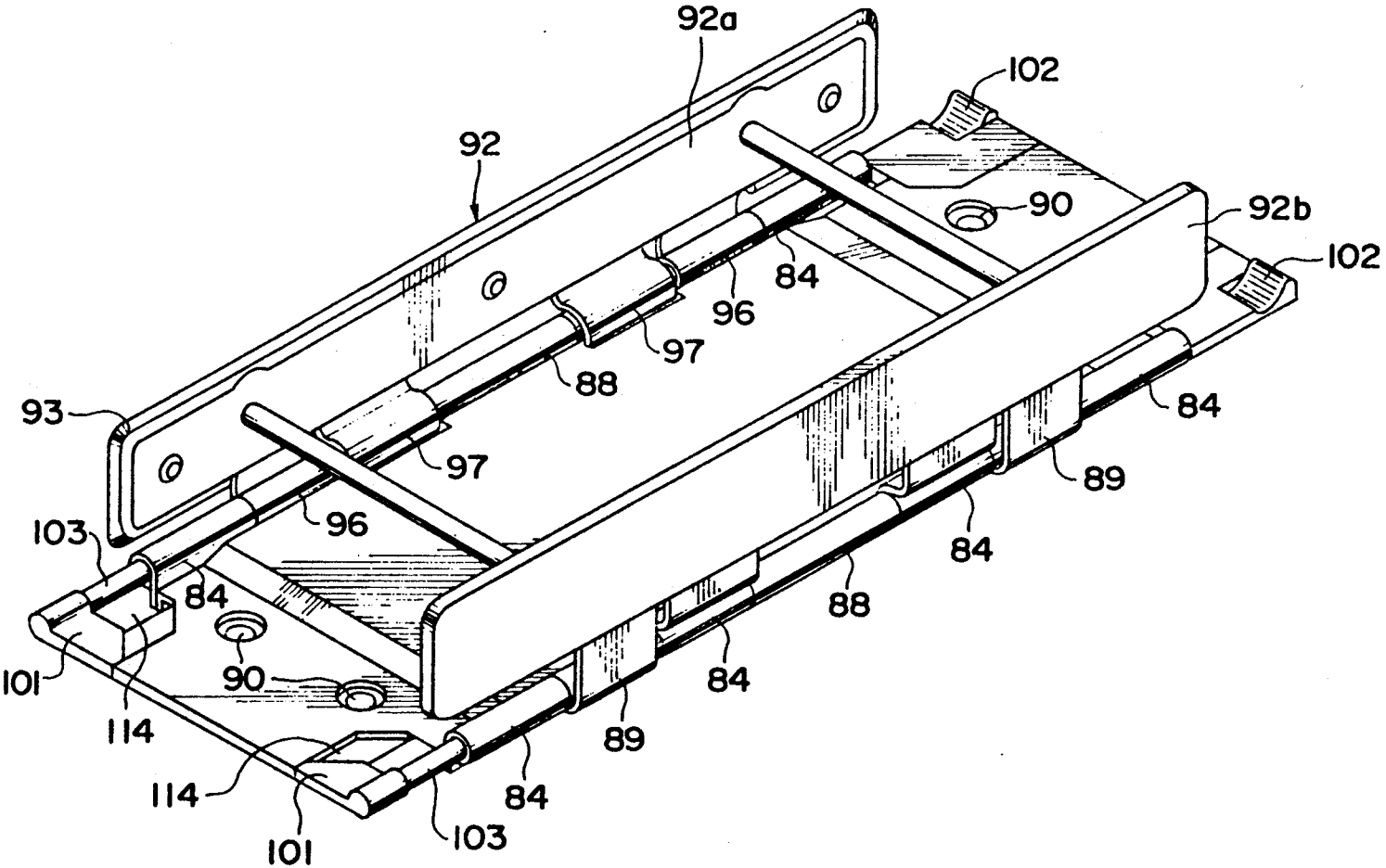
FIG. 12 is a whole perspective view of the third embodiment of the invention.

FIGS. 10 and 11 show a modification of the second embodiment and differ from the second embodiment with respect to a point that the attaching member 41 is divided into a left attaching member 41*a* and a right attaching member 41*b* with respect to a symmetrical line with regard to the right and left positions. As shown in FIG. 11, the modification has a construction such that the attaching member can be commonly used in the case where a width of rear side cover 76*a* of a cover plate 76 differs. Although the detailed descriptions are omitted here, the same component elements in the modification as those in the second embodiment are designated by the same reference numerals.

Further, the third embodiment of the invention will be described with reference to FIGS. 12 to 15.

An attaching member 81 comprises: a rectangular base plate 82 made of a metal; and a rectangular cover 83 made of a synthetic resin which is attached so as to cover the upper surface of the base plate 82. Four axial pipes 84 are respectively provided at the symmetrical positions of both sides in the longitudinal direction of the base plate 82. Attaching holes 85 to attach the base plate 82 to the cover plate or the like and caulking holes 86 to attach the cover 83 are formed at both edge positions in the longitudinal direction of the base plate 82. Stop members 87 and guide members 115 are provided at the symmetrical positions of the right and left half portions in the short width direction.

Cover members 88 which are upwardly curved like a convex shape and guide ribs 89 which are downwardly bent are provided on both sides in the longitudinal direction of the cover 83. The cover members 88 are located in the central portions of both sides in the longitudinal direction of the cover 83 and in one edge portion and cover the exposed portions of coupling rods 106, which will be explained hereinlater, from the upper position. The guide ribs 89 are located at the front and back positions. At the positions corresponding to the attaching holes 85 of the base plate 82, recess portions 90 with holes which are fitted to the attaching holes 85 are formed. Pillar-shaped projecting shafts 91 to hold the interval are formed on the lower surfaces corresponding to the caulking holes 86, respectively. By overlaying the cover 83 onto the upper surface of the base plate 82 and caulking the lower edges of the projecting shafts 91 into the caulking holes 86, the attaching member 81 having a desired gap between the base plate 82 and the cover 83 is constructed.

Figure 13:
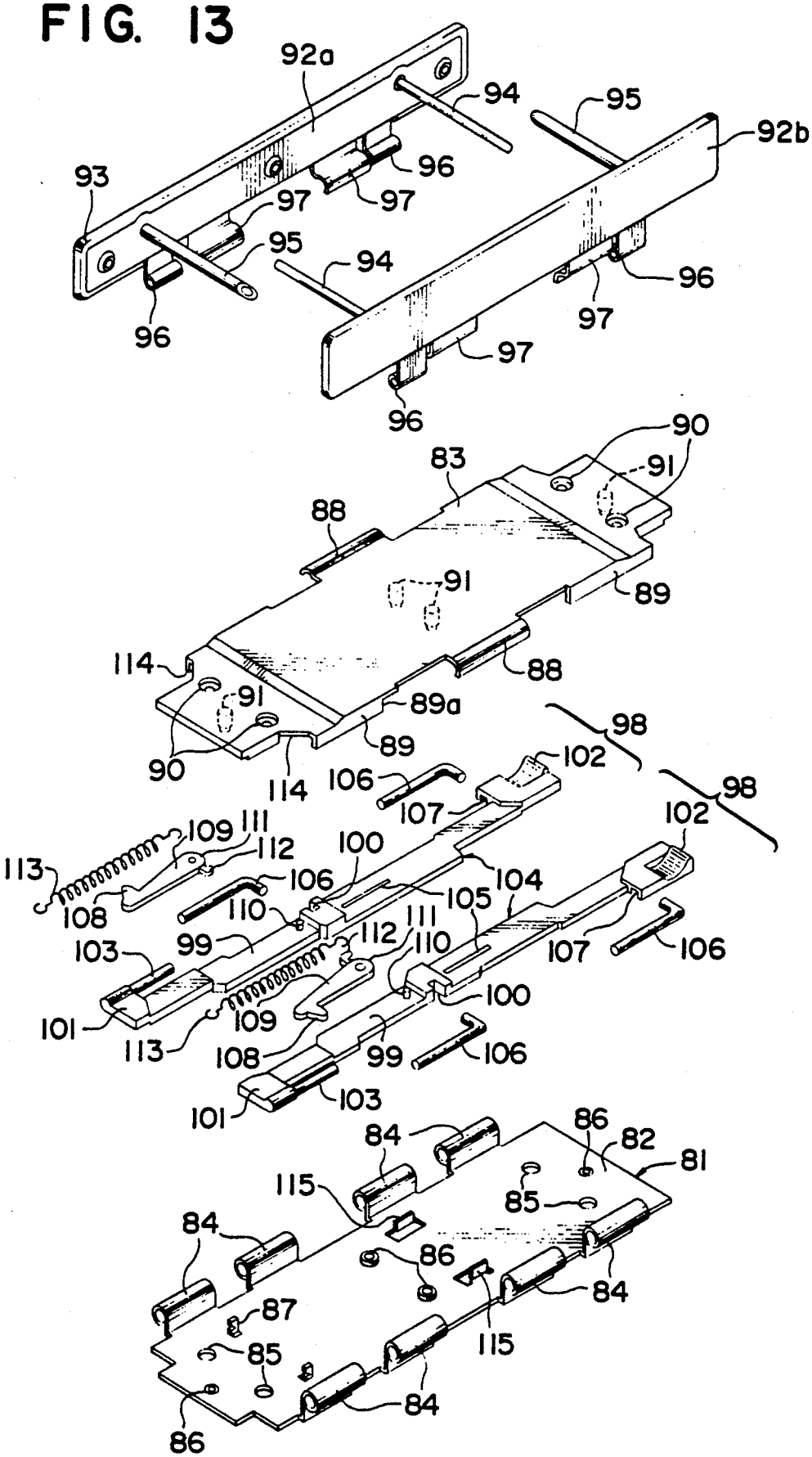
FIG. 13 is an exploded perspective view of the third embodiment of the invention.

A pair of right and left opening/closing members 92 which are rotatably coupled to the attaching member 81 are constructed by fixing the peripheral edges of inner plates 92*a* made of a metal by outer peripheral holding portions 93 of outer plates 92*b* made of a synthetic resin. In both edge portions in the longitudinal direction of the inner plates 92*a*, spike-shaped filing rods 94 and tubular filing rods 95 are respectively attached at both edge portion positions in the longitudinal direction of the inner plates 92*a* so that the right and left opening/-closing members 92 can be commonly used as shown in FIG. 13. At the lower edges of the inner plates 92*a* constructed as mentioned above, a pair of front and back axial pipes 96 and a pair of front and back inducing members 97 are provided. The axial pipes 96 are coupled to the axial pipes 84 of the attaching member 81. The inducing members 97 are inwardly curved. When the opening/closing members 92 are coupled to the attaching member 81, the inducing members 97 are fitted to the outer peripheral surfaces of the axial pipes 84 of the attaching member 81 while coming into slide contact therewith and inwardly move one opening/-closing member 92.

A pair of right and left coupling mechanisms 98 which rotatably couple the opening/closing members 92 to the attaching member 81 are respectively arranged at the right and left half portion positions in the short width direction in the gap formed between the base plate 82 and the cover 83. The coupling mechanism 98 is constructed in the following manner. A concave surface 99 is formed in a part of the upper surface in the longitudinal direction of the elongated member made of a synthetic resin. A notch portion 100 is formed in the intermediate portion in the longitudinal direction. A pressing type operating member 101 of a wide width is provided in one edge portion in the longitudinal direction. The coupling mechanism 98 comprises: a guide shaft 103; an operating rod 104; a pair of front and back coupling rods 106; and a spring 113. The guide shaft 103 is provided in the outside portion of the coupling mechanism and is slidably fitted to the axial pipe 84 locating in one edge portion of the attaching base plate 82. The operating rod 104 is provided with a pulling type operating member 102 having a finger touching portion with concave notches in the other edge portion and a groove portion 107 which is bent in an L-character shape at the lower surface. The coupling rods 106 are bent in an L-character shape and the bent edges are respectively come into engagement with the notch portion 100 and groove portion 107. The spring 113 always elastically presses the operating rod 104 in one direction. The operating rod 104 is arranged so as to be slidable in the front and back directions on the base plate 82 by allowing a slit 105 formed on the operating rod 104 to be come into engagement with the guide member 115 provided on the base plate 82 and by fitting the guide shaft 103 to the axial pipe 84 of the base plate 82.

A holding mechanism to hold the non-coupling state of the coupling mechanism 98 comprises: a holding lever 109 in which a base portion is horizontally rotatably axially supported to the concave surface 99 of the operating rod 104 through the shaft member and a claw member 108 is projected in the free edge portion; and the spring 113 to always outwardly apply a rotating force to the holding lever 109. In the embodiment, there is shown the case where the spring 113 is disposed between a stop member 112 provided in the base portion of the holding lever 109 and the stop member 87 provided for the base plate 82, thereby commonly using the spring 113 in the coupling mechanism 98 and the spring 113 in the holding mechanism.

In the coupling state between the attaching member 81 and the opening/closing member 92, the claw member 108 of the holding lever 109 is come into pressure contact with the inner surface of the guide rib 89 provided for the cover 83 by the rotating force of the spring 113. When the operating rod 104 slides against the pressing force of the spring 113 and the coupling state of the attaching member 81 and the opening/closing member 92 is released, the claw member 108 is projected outwardly by an inner edge 89*a* of the guide rib 89 and the claw member 108 is retained to the inner edge 89*a* of the guide rib 89.

A cut-out portion 114 is provided at the corner position in one edge portion in the longitudinal direction of the attaching member 81. The pressing type operating member 101 and the pulling type operating member 102 of the coupling mechanism 98 face such a corner position so as to be movable in the front and back directions, respectively. In the inoperative state of FIG. 12 in which the pair of right and left opening/closing members 92 stand up and face each other and file the sheets, as shown at the left half portion position of FIG. 15, in a state in which the operating rod 104 is elastically pressed by the spring 113, the front and back coupling rods 106 are projected from the axial pipes 84 of the attaching member 81 into the axial pipes 96 of the opening/closing member 92. Thus, the attaching member 81 is coupled with the opening/closing member 92. The claw member 108 of the holding lever 109 is come into pressure contact with the inner surface of the guide rib 89 by the rotating force by the spring 113.

In the inoperative state, when the pressing type operating member 101 or the pulling type operating member 102 is pressed or pulled against the spring 113 so as to remove either one of the opening/closing members 92 away from the attaching member 81, the operating rod 104 slides in the upper direction in the diagram. As shown at the right half portion position in FIG. 15, the coupling rod 106 is ejected out from the axial pipe 96 of the opening/closing member 92 and enters the axial pipe 84 of the attaching member 81. The coupling state of the axial pipes 84 and 96 is released. Due to the sliding of the operating rod 104, the claw member 108 of the holding lever 109 which is in pressure contact with the inner surface of the guide rib 84 is outwardly projected from the inner edge 89*a* of the guide rib 89. The claw member 108 is retained to the inner edge 89*a* and the sliding state of the operating rod 104, namely, the non-coupling state of one coupling mechanism 98 is held.

Figure 14:
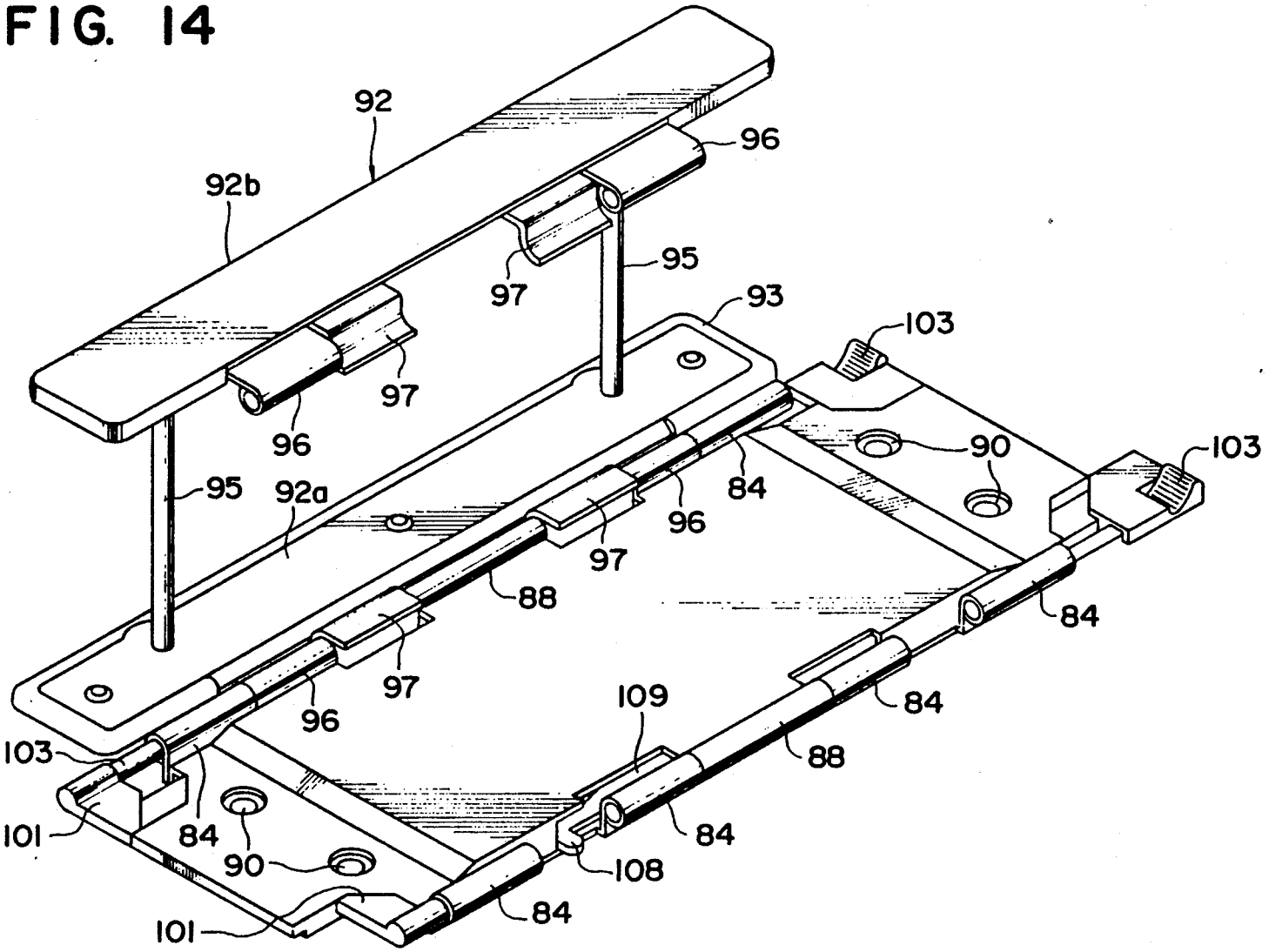
FIG. 14 is a perspective view of a state in which one of opening/closing members in the third embodiment of the invention is opened.
Figure 15:
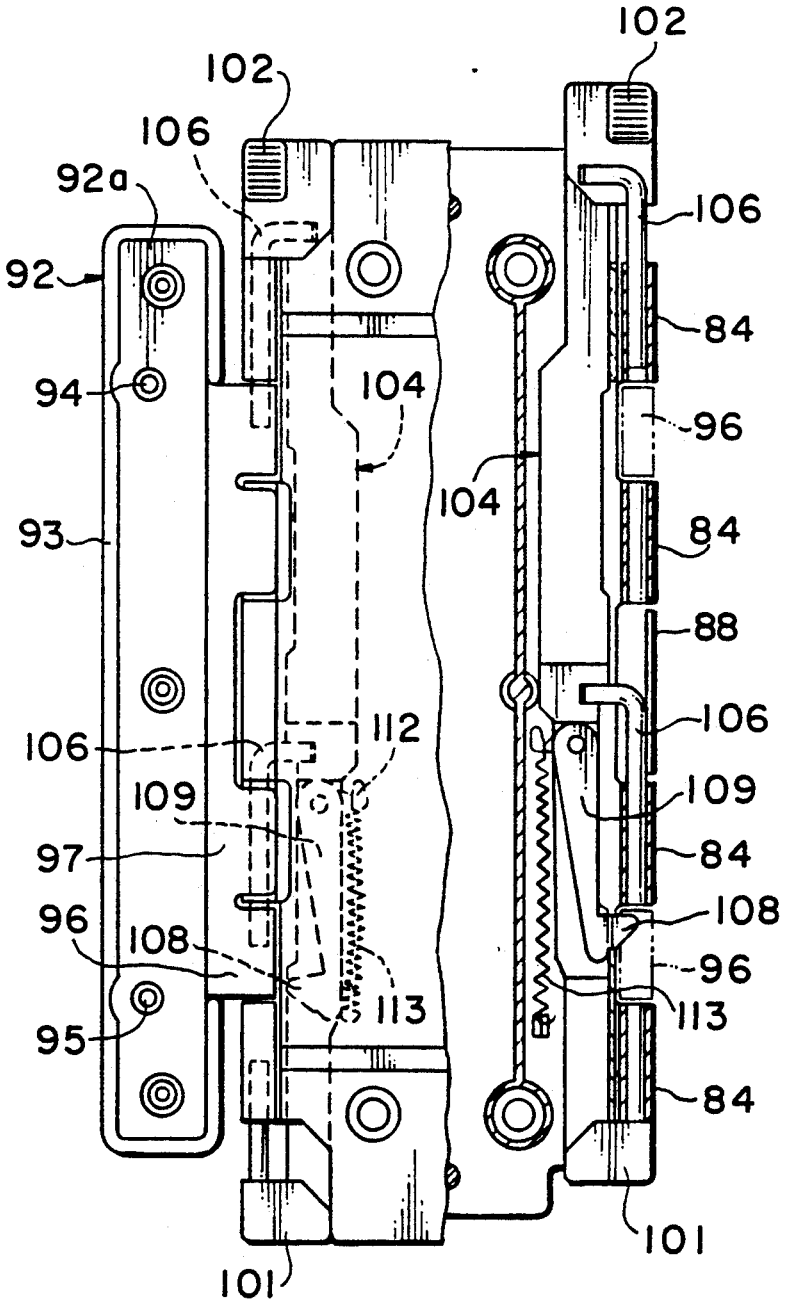
FIG. 15 is a plan view of the third embodiment of the invention with a part cut away and with a part omitted.
Figure 16:
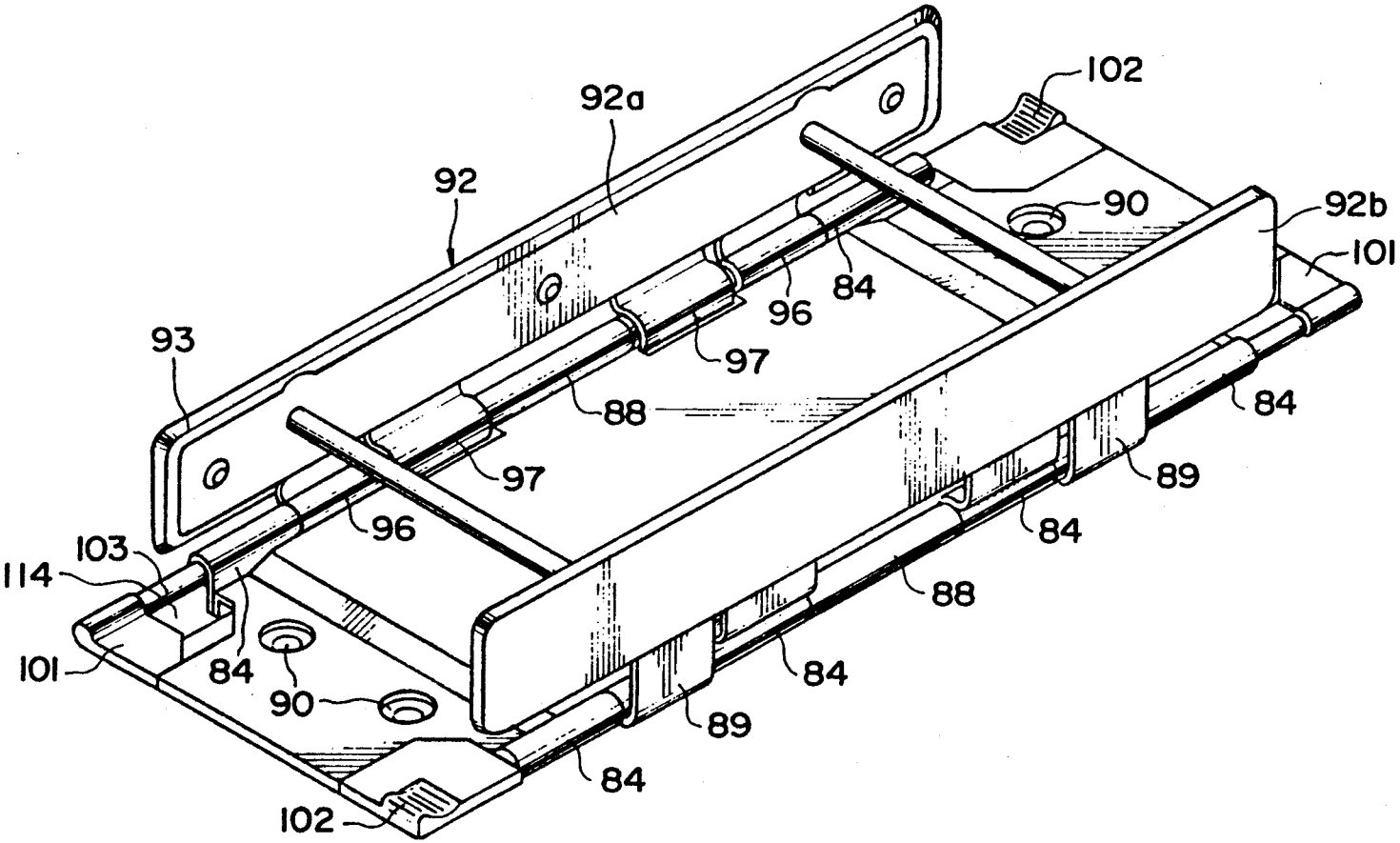
FIG. 16 is a whole perspective view in a modification of the third embodiment of the invention.
Figure 17:
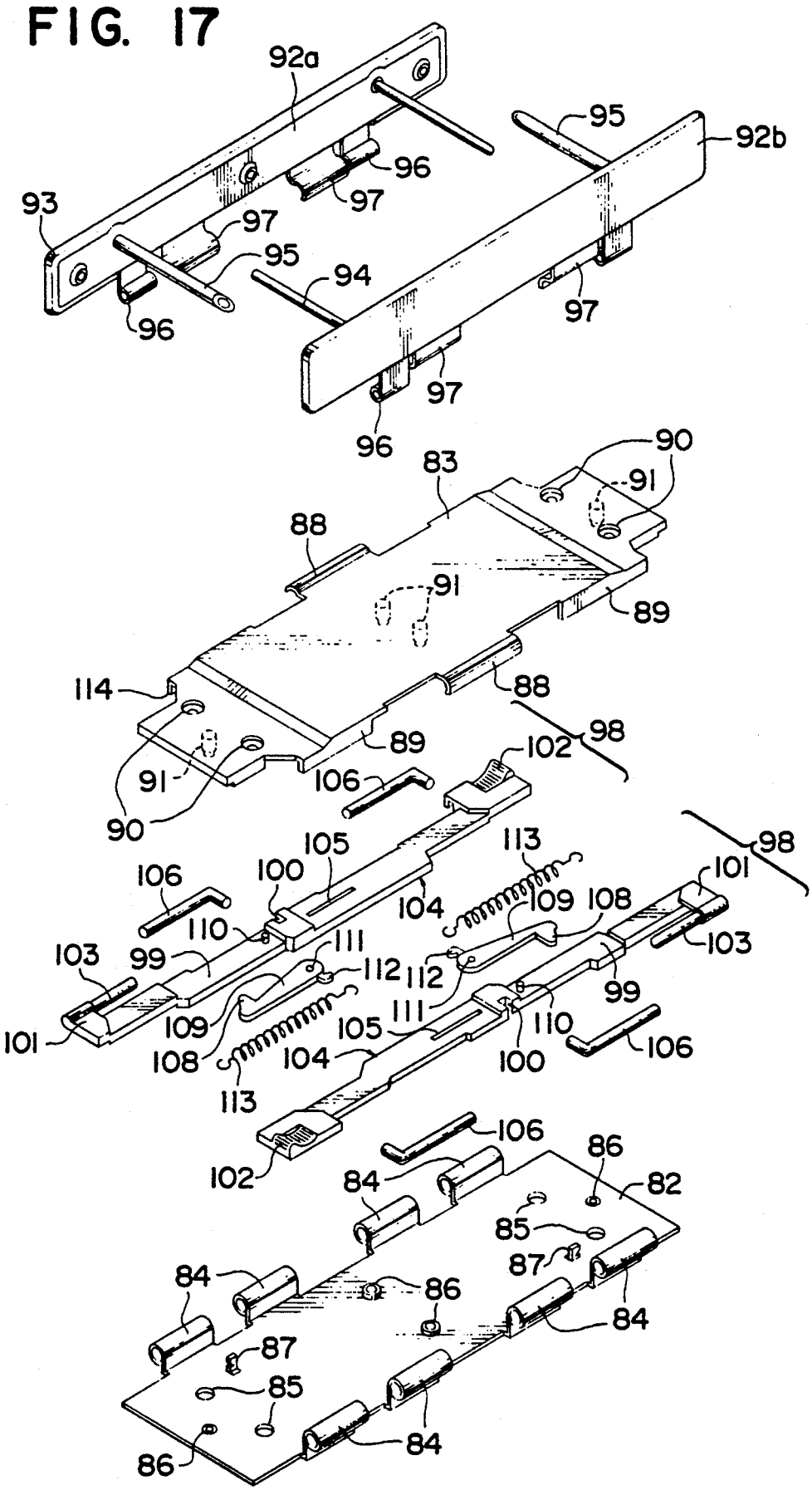
FIG. 17 is an exploded perspective view in the modification of the third embodiment of the invention.
Figure 18:
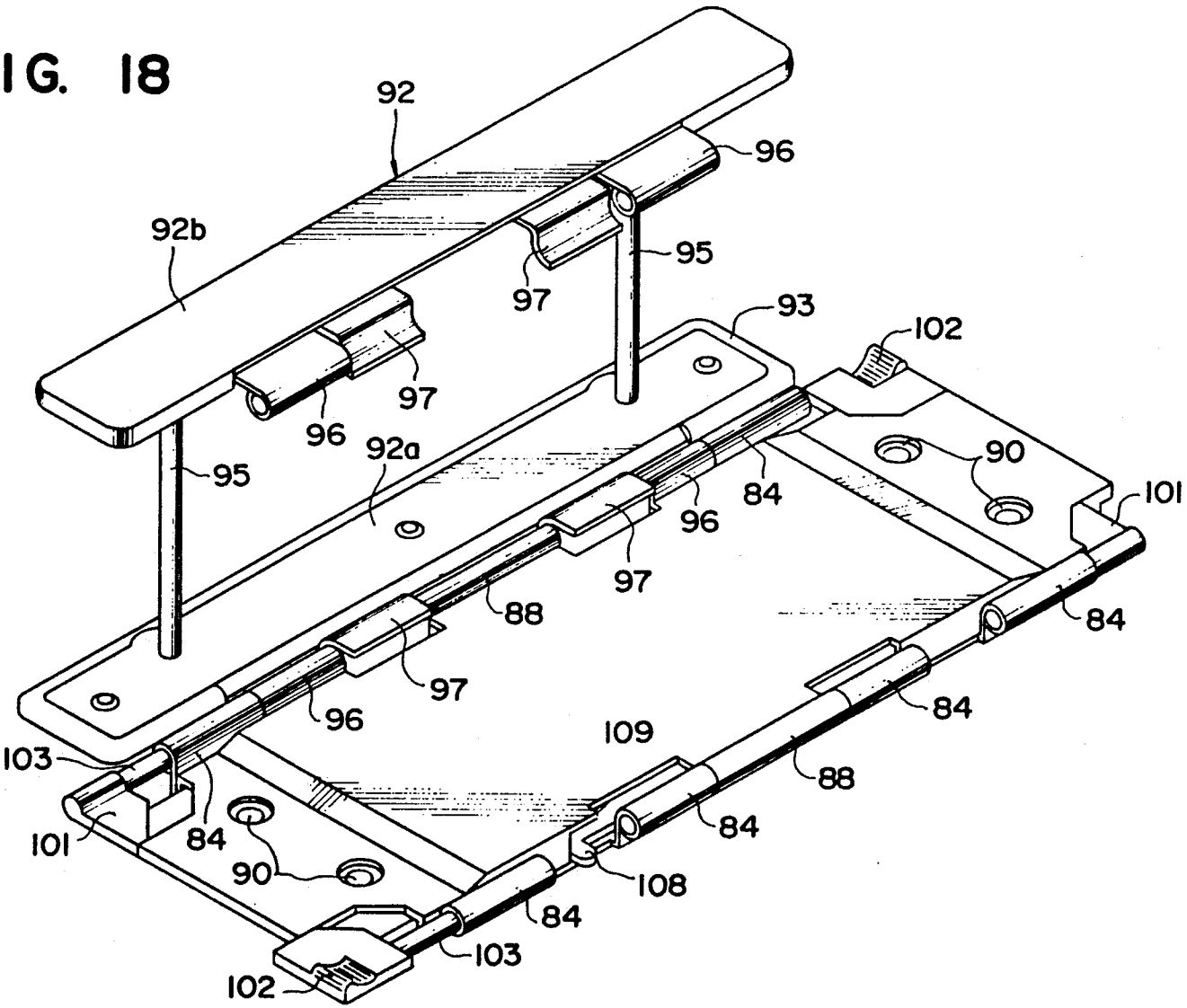
FIG. 18 is a perspective view of a state in which one of opening/closing members in the modification of the third embodiment of the invention is opened.
Figure 19:
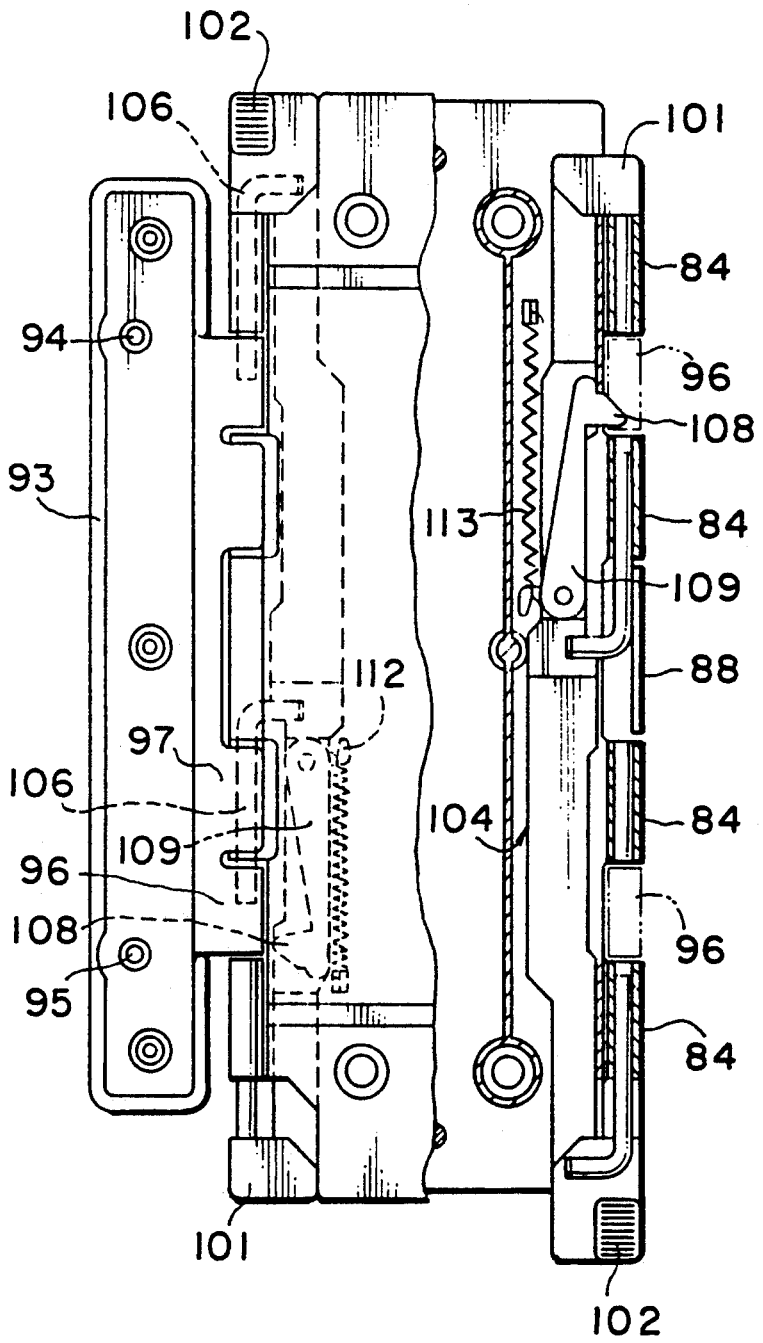
FIG. 19 is a plan view of the modification of the third embodiment of the invention with a part cut away and with a part omitted.
Figure 20:
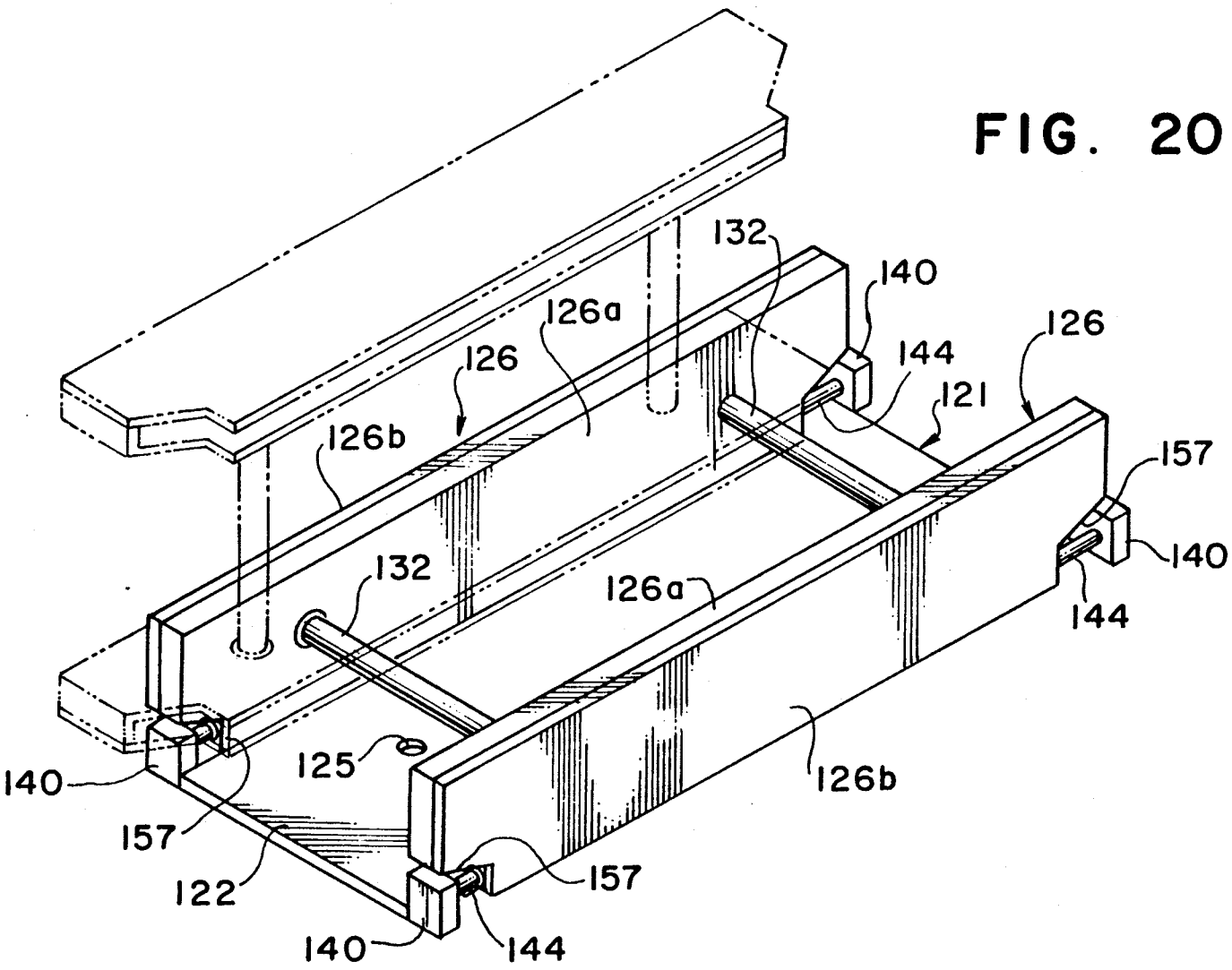
FIG. 20 is a whole perspective view of the fourth embodiment of the invention.

As mentioned above, when the coupling state of one opening/closing member 92 and the attaching member 81 is released, the other opening/closing member 92 which is rotatably coupled with the attaching member 81 rotates outwardly by the weight of the sheets. The spike-shaped filing rods 94 and the tubular filing rods 95 stand up. As shown in FIG. 14, the pair of right and left opening/ closing members 92 are set into a state in which they face each other in the vertical direction.

Therefore, in a manner similar to the above, when the opening/closing member 92 removed away from the attaching member 81 is removed from the other opening/closing member 92 and the filing holes formed in the sheets or the like are pierced to the filing rods 94 and 95 and the opening/closing member 92 is again coupled to the other opening/closing member 92 and, after that, the other opening/closing member 92 is allowed to stand up and rotates for the attaching member 81, the curved inner surface of the inducing member 97 is fitted to the outer peripheral surface of the axial pipe 84. Thus, one opening/closing member 92 is inwardly attracted and the positions of the axial pipes 96 coincide with the coupling positions with the axial pipes 84 of the attaching member 81.

Thus, the axial pipe 96 of the opening/closing member 92 is come into contact with the front edge of the claw member 108 of the holding lever 109 projecting from the side of the attaching member 81. The claw member 108 is inwardly passed against the spring 113. Therefore, the engaging state between the inner edge 89*a* of the guide rib 89 and the claw member 108 is released. The operating rod 104 is automatically returned to the inoperative position by the elastic pressing force of the spring 113. The coupling rod 106 couples the axial pipes 84 and 96. The pair of right and left opening/closing members 92 again face each other in the standing state.

FIGS. 16 to 19 show a modification of the third embodiment. The modification differs from the third embodiment with respect to points that the pressing type operating member 101 is arranged in one of the end portions of one of the edge portions of the attaching member 81, the pulling type operating member 102 is arranged in the other end portion, the pulling type operating member 102 is arranged in one of the end portions of the other edge portion, and the pressing type operating member 101 is arranged in the other end portion. In the modification, since the pressing type operating members 101 and the pulling type operating members 102 are symmetrically arranged in the diagonal line direction, the attaching member 81 can be attached without considering the direction of the attaching member. Although the detailed description is omitted here, the same component elements in the modification as those in the third embodiment are designated by the same reference numerals.

The fourth embodiment of the invention will be further described with reference to FIGS. 20 to 27. An attaching member 121 has axial pipes 123, 124, and 158 at the front and back positions and a central portion of both sides in the longitudinal direction of a rectangular base plate 122. Attaching holes 125 to attach the attaching member to the cover plate are formed at both edge portion positions in the longitudinal direction.

Opening/closing members 126 which are rotatably coupled to the right and left side edges of the attaching member 121 comprise inner plates 126*a* and outer plates 126*b*. The inner plate 126*a* has outwardly bent ribs 127 at the upper edge and the front and back edges and two axial pipes 128 and 129 to respectively couple the axial pipes 123 and 124 at the lower edge front and back positions. The outer plate 126*b* is attached to an interval member 130 in a manner such that the upper edge and the front and back edges come into contact with the rib 127 and a space portion occurs between the inner plate 126*a* and the outer plate 126*b*. Spike-shaped filing rods 131 are projected on the inner surfaces of both edge portions in the longitudinal direction of the inner plate 126*a*. Tubular filing rods 132 are projected in the other edge portions.

A coupling mechanism 133 to couple the opening/-closing member 126 to the attaching member 121 is constructed by allowing a rack member 161 formed at the edge of a front operating plate 137*a* and a rack member 162 formed at the edge of a back operating plate 137*b* to face each other in the vertical direction and by interposing a pinion 163 between the rack members 161 and 162. Coupling rods 136 are respectively provided for the pair of front and back operating plates 137*a* and 137*b* which are interlockingly coupled in the facing directions by the pair of rack members 161 and 162 and the pinion 163 so that the coupling rods 136 extend in the facing directions.

Bent members 136*a* of the coupling rods 136 which are bent in an L-character shape and are pierced into the corresponding axial pipes 128 and 129 are respectively come into engagement with engaging holes 135 formed at the lower edge front and back positions of the pair of front and back operating plates 137*a* and 137*b* which are relatively movably arranged between the inner plate 126*a* and the outer plate 126*b* of the opening/closing member 126 through a long hole 134 which is come into engagement with the interval member 130. There are arranged springs 138 for always elastically pressing the operating plates 137*a* and 137*b* in such directions that the coupling rods 136 are projected out from the corresponding axial pipes 128 and 129.

Figure 24:
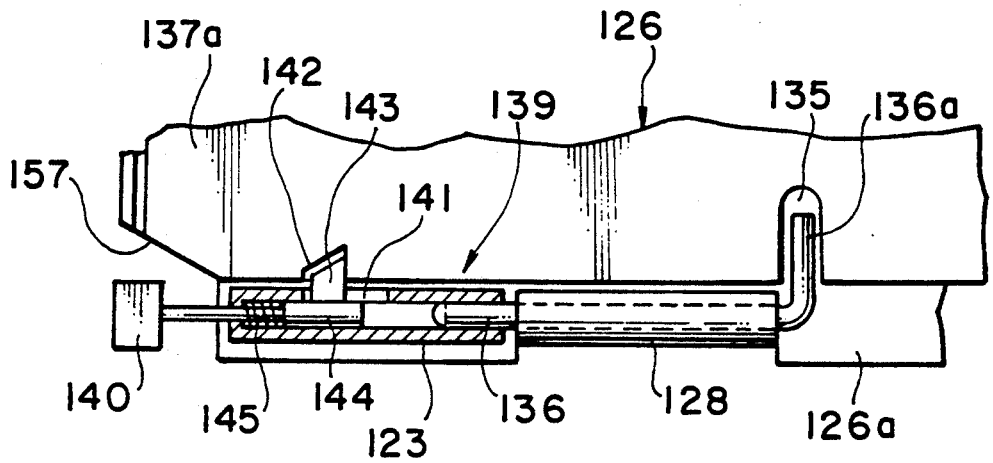
FIG. 24 is a partial enlarged diagram in which an operating member in the coupling state in the fourth embodiment of the invention is partially cut out.
Figure 25:
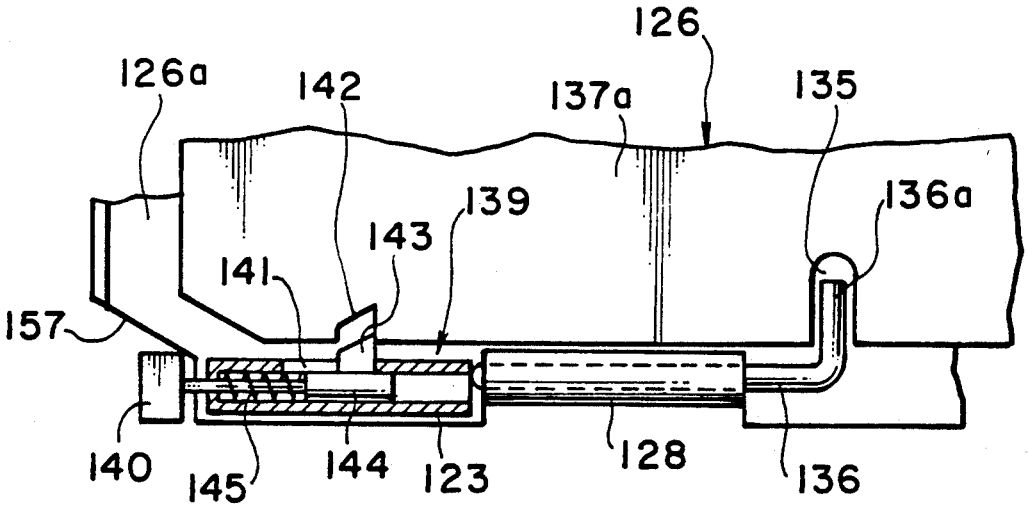
FIG. 25 is a partial enlarged diagram in which the operating member in the non-coupling state of the fourth embodiment of the invention is partially cut out.

Operating members 139 for pushing the operating plates 137*a* and 137*b* against the springs 138 to thereby release the coupling state of the attaching member 121 and the opening/closing members 126 are slidably fitted into the axial pipes 123 located in both side edge portions of the attaching member 121. As shown in FIG. 24, the operating member 139 comprises an operating rod 144 and a spring 145. The operating rod 144 has a finger pressing portion 140 at the outer edge. At the inner edge, the operating rod 144 has a projection 143 which is projected upwardly from a slit 141 formed in the upper surface of the axial pipe 123 and comes into engagement with a concave portion 142 formed at the lower edge of the operating plate 137*a*. The spring 145 always presses the operating rod 144 in the pushing direction by an elastic force which is weaker than the elastic force of the spring 138.

Further, a holding mechanism 146 to hold the non-coupling state of the coupling mechanism 133 has a holding member 150 made of a synthetic resin. The holding member 150 is arranged into a notch concave portion 148 so that it can be vertically inclined, while a base portion 149 is fitted into a recess portion 147. The notch concave portion 148 opens at the lower edge provided in the back operating plate 137*b* and has the recess portion 147 in one edge portion. A retaining claw 149 is provided in a free edge portion of the holding member 150. At the upper surface of the holding mechanism 146, an elastic member 152 is integratedly provided. The elastic member 152 is come into pressure contact with the inner surface of the notch concave portion 148 and always applies a downward inclining force to the holding member 150. A leg member 153 is integratedly provided at the lower surface of the holding mechanism 146. The leg member 153 is come into pressure contact with the upper surface of the intermediate axial pipe 158 of the attaching member 121 by the pressing force of the elastic member 152. A stop member 154 is provided at the inner surface of the outer plate **126*b* corresponding to the retaining claw 149. When the operating plates 137*a* and 137*b* relatively move and the coupling state between the attaching member 121 and the opening/closing members 126 is released and the holding member 150 is downwardly inclined, the stop member 154 is retained to the retaining claw 149, thereby restricting the relative movements of the operating plates 137*a* and 137*b***.

A notch portion 157 to allow the movement of the finger pressing portion 140 is formed in the lower edge corner portion of the opening/closing member 126 corresponding to the finger pressing portion 140 of the operating member 139.

Figure 21:
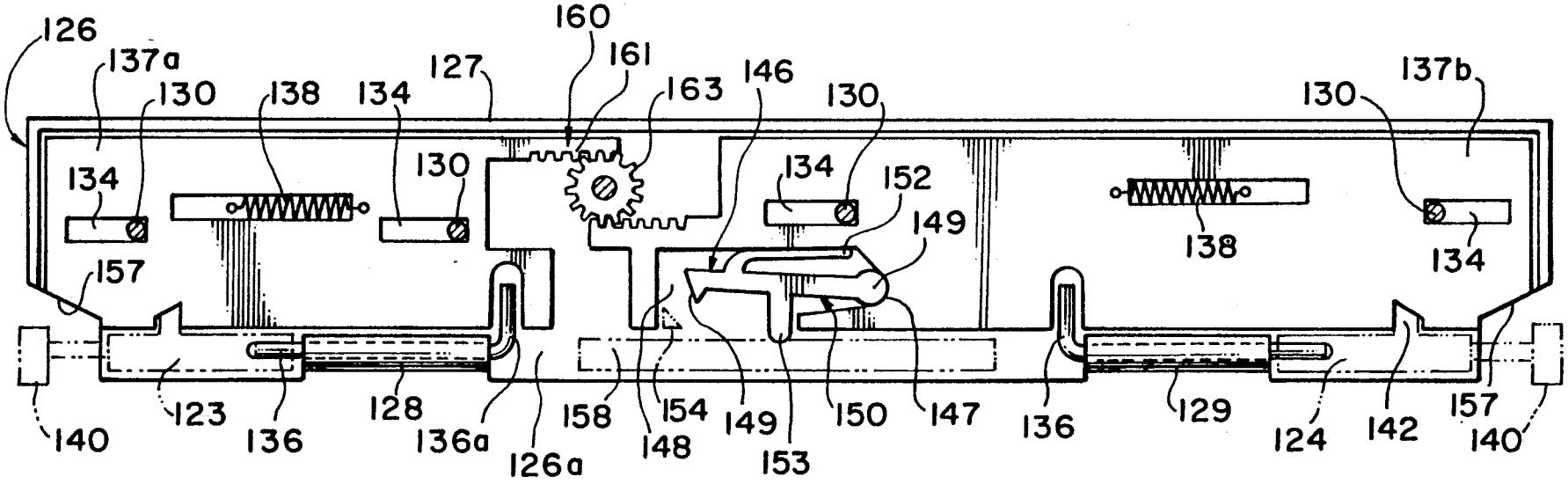
FIG. 21 is an inside view of an opening/closing member showing a coupling state of the fourth embodiment of the invention.

In the inoperative state in which the opening/closing members 126 are coupled to the attaching member 121 and the sheets are filed, as shown in FIG. 21, the pair of front and back operating plates **137*a* and 137*b* are relatively moved by the springs 138 in such directions as to be away from each other. The coupling rods 136 are projected into the axial pipes 123 and 124 of the attaching member 121 from the axial pipes 128 and 129 of the opening/closing members 126. In such an inoperative state, when the finger pressing portion 140 of either one of the right and left operating members 139 located at the front and back positions is depressed, the pair of front and back operating plates 137*a* and 137*b* relatively move and approach by the engagement between the pinion 163 and the rack members 161 and 162 due to the retaining state between the concave portion 142 and the projecting portion 143**.

Figure 22:
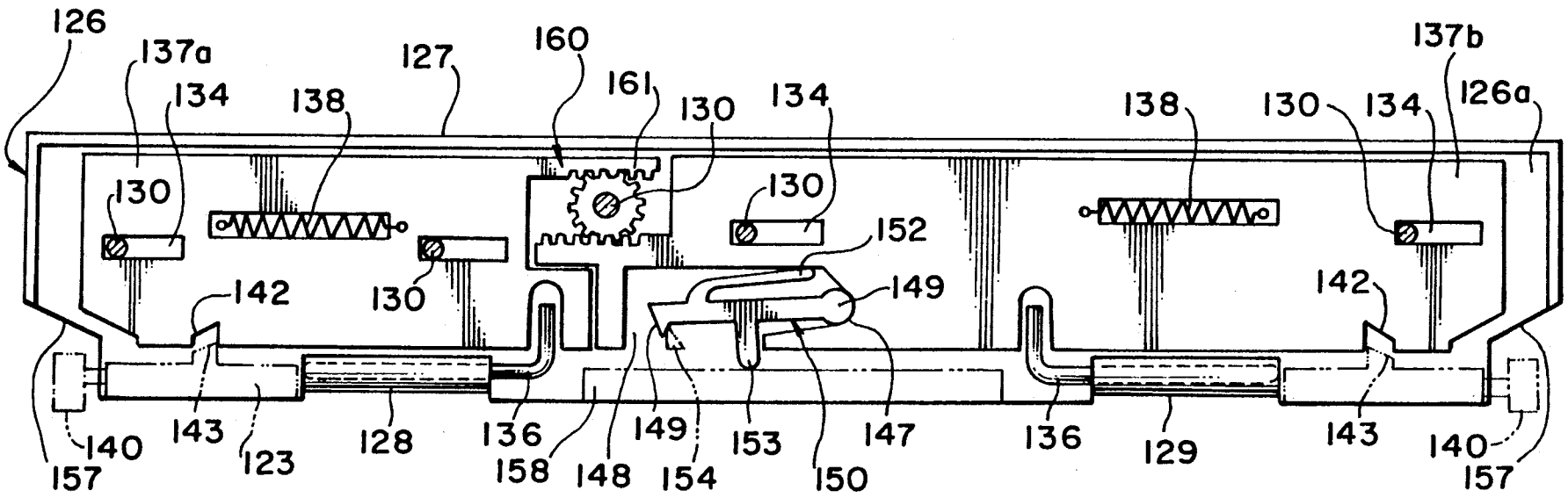
FIG. 22 is an inside view of the opening/closing member showing a non-coupling state of the fourth embodiment of the invention.
Figure 23:
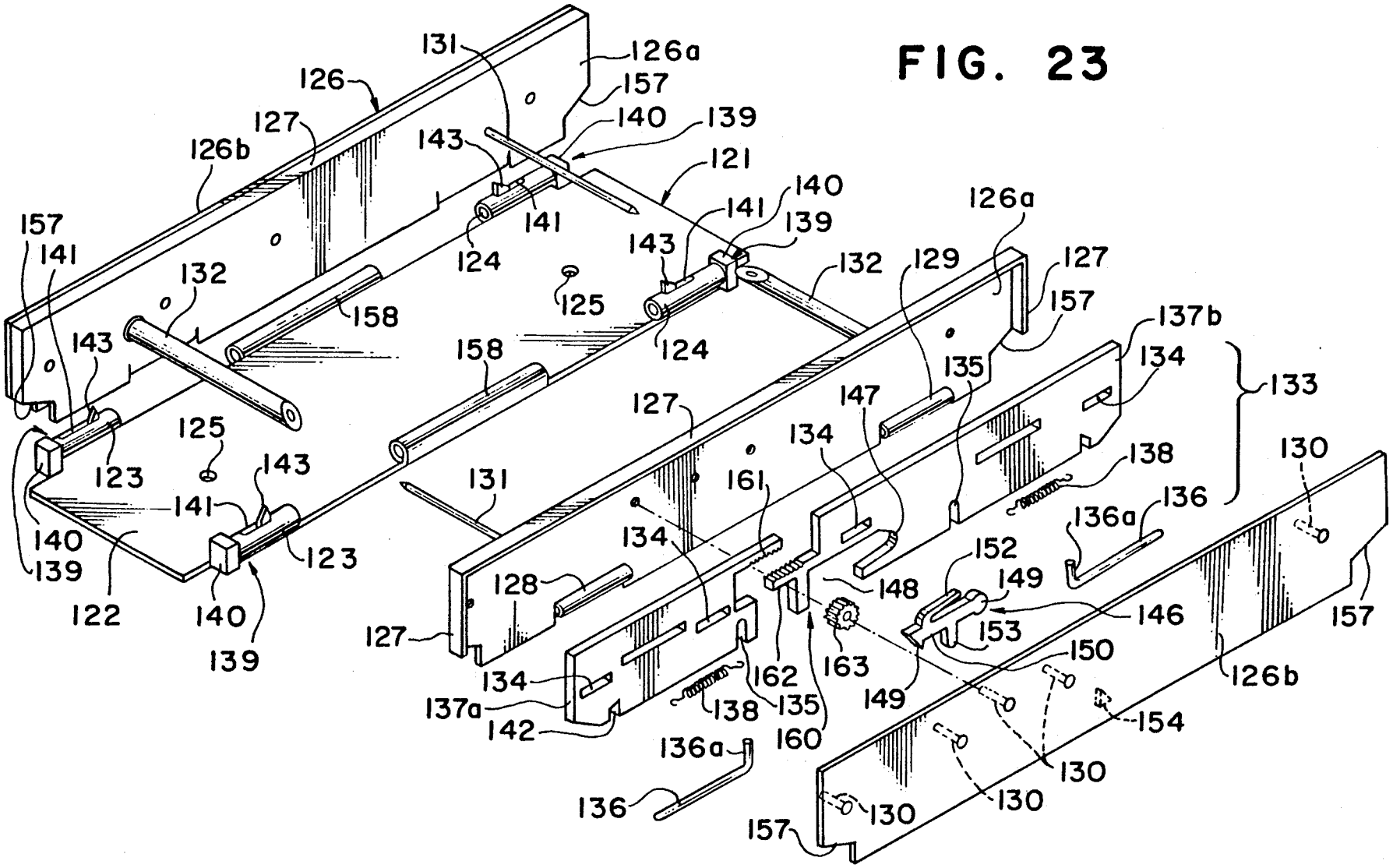
FIG. 23 is an exploded perspective view of the fourth embodiment of the invention.

As shown in FIG. 22, consequently, the front and back coupling rods 136 are ejected out from the axial pipes 123 and 124 of the attaching member 121 and enter the axial pipes 128 and 129 of one opening/closing member 126, so that the coupling state between them is released. The opening/closing member 126 slightly floats up from the attaching member 121 by the elastic force of the elastic member 152, so that the holding member 150 is downwardly inclined and retained to a retaining claw 151 and the stop member 154. The operative states of the operating plates **137*a* and 137*b*** are restricted.

As mentioned above, after the coupling state between one opening/closing member 126 and the attaching member 121 was released, the other opening/closing member 126 which is rotatably coupled with the attaching member 121 is outwardly rotated by the weight of the sheets. The filing rods 131 and 132 stand up and the pair of right and left opening/closing members 126 are set into a state in which they face each other in the vertical direction as shown by virtual lines in FIG. 20.

Therefore, as already mentioned above, when one opening/closing member 126 removed away from the attaching member 121 is removed from the other opening/closing member 126 and the filing holes formed in the sheets or the like are pierced to the filing rods 131 and 132 and the filing rods 131 and 132 are mutually pierced again and the sheets or the like are filed and, after that, the other opening/closing member 126 is rotated so as to stand up for the attaching member 121, the leg member 153 of the holding member 150 comes into contact with the upper surface of the axial pipe 158 of the corresponding attaching member 121. The holding member 150 is upwardly inclined against the elastic force of the elastic member 152. Thus, the retaining claw 151 is released from the stop member 154, so that the operating plates **137*a* and 137*b* are returned by the springs 138**.

On the other hand, when the opening/closing member 126 are rotated in the standing direction, since the operating rod 144 is inwardly elastically pressed by a spring 145, the concave portion 142 comes into engagement with the projection 143 and the axial pipes 128 and 129 and the axial pipes 123 and 124 coincide on the same axial line. Thus, the coupling rods 136 are respectively projected into the axial pipes 123 and 124 of the attaching member 121 from the axial pipes 128 and 129 of the opening/closing members 126 and the axial pipes are mutually coupled. The pair of right and left opening/closing members 126 again face in the standing state.

Figure 26:
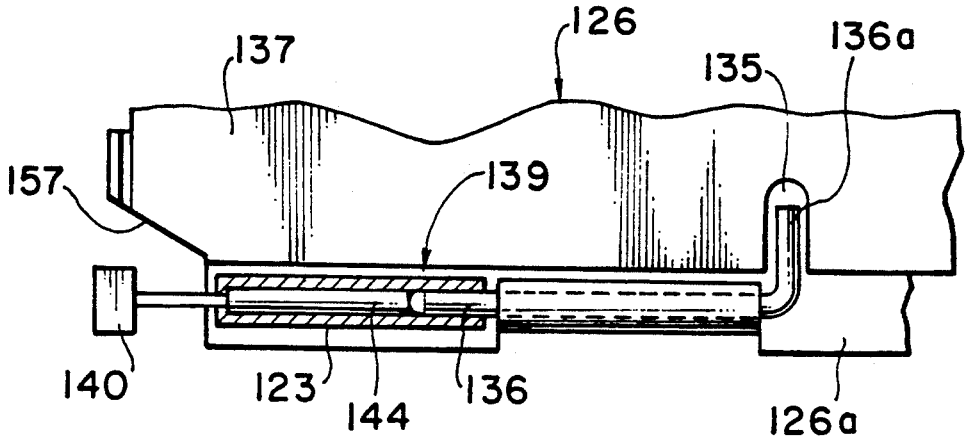
FIG. 26 is a modification diagram corresponding to FIG. 24 of the fourth embodiment of the invention.
Figure 27:
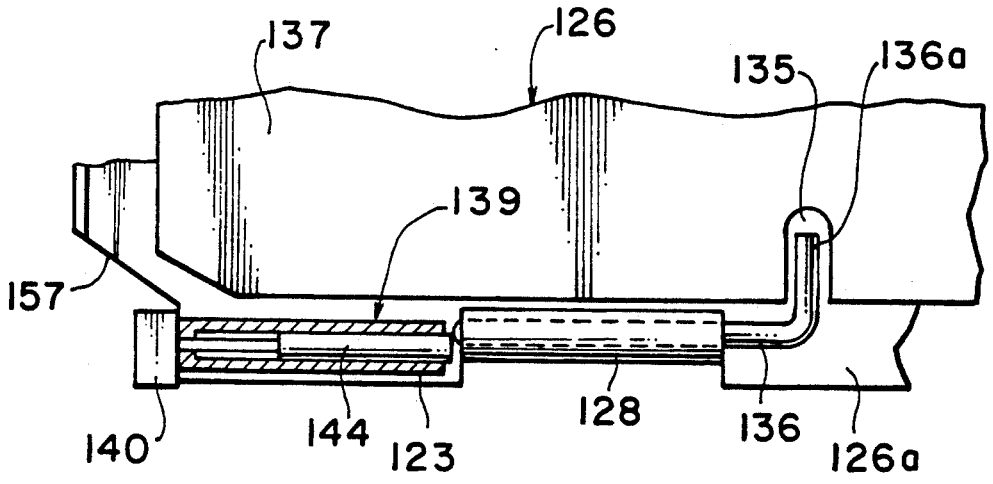
FIG. 27 is a modification diagram corresponding to FIG. 24 of the fourth embodiment of the invention.

FIGS. 26 and 27 show a modification of the operating member 139. The modification is constructed in the following manner. By depressing the finger pressing portion 140 provided at the outer edge of the operating rod 144 which is slidably fitted into the axial pipe 123 of the attaching member 121, the front edge of the coupling rod 136 which is pierced into the axial pipe 123 is directly pressed by the operating rod 144, thereby sliding the operating plate 137 to the non-coupling position against the spring 138. According to the above construction, the slit 141, concave portion 142, projection 143, and spring 145 can be omitted.

As mentioned above, the pair of front and back axial pipes 123 and 124 provided for the attaching member 121 and the pair of front and back axial pipes 128 and 129 provided for the opening/closing members 126 are respectively symmetrically provided from the center in the longitudinal direction. The axial pipes which are come into pressure contact with the leg member 153 of the holding member 150 are provided at the right and left positions of the central portion of the attaching member 121. Thus, the pair of right and left opening/closing members can be commonly used at the right and left positions of the attaching member.

We claim:

1. A filing apparatus of a both-side opening and closing type comprising;

an attaching member having coupling portions at right and left side edges;

a pair of right and left opening/closing members in which filing rods which can be mutually pierced are projected on inner surfaces and which have coupling portions which are coupled to said coupling portions;

a pair of right and left coupling mechanisms which include coupling rods and are movable between an inoperative position where said coupling rods are pierced to the coupling portions of said attaching member and the coupling portions of said opening/closing members corresponding to said coupling portions by elastic pressing forces, thereby rotatably coupling the coupling portions, and an operative position where when the coupling mechanisms are made operative against the elastic pressing forces, the coupling rods are inserted into respective ones of the coupling portions to thereby release the coupling state between the coupling portions;

a holding mechanism which is constructed in a manner such that the operative positions of the coupling mechanisms are held and, when the opening/closing members reach the coupling position from a position away from the attaching member, said position is detected and the holding state at said operative positions is released; and operating members which are respectively arranged at front, back, right, and left positions of said attaching member and operate the coupling mechanisms from the inoperative positions to the operative positions.

2. A filing apparatus according to claim 1, wherein said coupling portions of the attaching member and opening/closing members comprise axial pipes.

3. A filing apparatus according to claim 1 or 2, wherein each opening/closing member has an inducing member which inwardly induces the opening/closing member in cooperation with the axial pipes of the attaching member when said opening/closing member reaches the coupling position with the attaching member.

4. A filing apparatus according to claim 2 wherein the attaching member is provided with the coupling mechanisms and the holding mechanism and the coupling rods are pierced to the axial pipes of the attaching member so that they can be freely inserted into or ejected out from the axial pipes.

5. A filing apparatus according to claim 4, wherein the attaching member comprises a rectangular base plate and a cover which covers the upper surface of said base plate and is attached so that a desired gap exists between the base plate and said cover, and the coupling mechanism and the holding mechanisms are arranged at the right and left positions of said gap portion, respectively.

6. A filing apparatus according to claim 2 wherein said attaching member is divided into two right and left portions.

7. A filing apparatus according to claim 2 wherein each said coupling mechanism comprises an operating rod which is attached so as to be slidable in the front and back directions of said attaching member and which has said coupling rod and elastic force applying means for always elastically pressing the operating rod in such a direction that the coupling rod is projected out from the axial pipe of the attaching member, and a pressing operating member and a pulling operating member respectively arranged at the front and back positions of the operating rod.

8. A filing apparatus according to claim 2 wherein said holding mechanism comprises a horizontally rotatable holding member having a claw member in a free edge portion, in which said claw member is constructed in a manner such that when the coupling rod enters the axial pipe of the attaching member at the operative position and releases the coupling state with the opening/closing member, the claw member is retained to the attaching member at the coupling position of the axial pipe of the opening/closing member to thereby hold the inserting state of the coupling rod, and in such a state, when the axial pipe of the opening/closing member whose coupling state has been released reaches the coupling position, the claw member acts on the axial pipe and releases the retaining state with the attaching member; and elastic force applying means for always applying a rotating force to the holding member in such a direction that the claw member is retained to the attaching member.

9. A filing apparatus according to claim 2, wherein each said coupling mechanism is constructed by an operating rod which is attached so as to be slidable in the front and back directions of the attaching member and which has the coupling rod, said holding mechanism is constructed by a holding member having a claw member in a free edge portion, in which said claw member is constructed in a manner such that when the coupling rod enters the axial pipe of the attaching member at the operative position, the coupling state with the opening/closing member is released and the claw member is retained to the attaching member at the coupling position of the axial pipe to thereby hold the inserting state of the coupling rod, and in the above state, when the axial pipe of the opening/closing member whose coupling state has been released reaches the coupling position, the claw member acts on the axial pipe and releases the retaining state with the attaching member, a base portion of the holding member being horizontally rotatably pivotally attached to the operating rod, elastic force applying means disposed between the base portion of the holding member and the attaching member, said elastic force applying means always elastically pressing the operating rod in such a direction that the coupling rod is projected out from the axial pipe of the attaching member and always applying a rotating force to the holding member in such a direction that the claw member is retained to the attaching member, and a pressing operating member and a pulling operating member respectively arranged at the front and back positions of the operating rod.

10. A filing apparatus according to claim 1, wherein each said operating member comprises a finger touching portion of a wide width and a notch portion to allow the front and back motions of said finger touching portion.

11. A filing apparatus according to claim 1, wherein one of the filing rods which can be mutually pierced has a spike shape and the other has a tubular shape, and the spike-shaped filing rod and the tubular filing rod are respectively projected to said pair of opening/closing members.

12. A filing apparatus according to claim 7, wherein the pressing operating members are arranged at the right and left positions in one edge portion of the attaching member and the pulling operating members are arranged at the right and left positions in the other edge portion, respectively.

13. A filing apparatus according to claim 7, wherein the pressing operating member is arranged in one of the end portions of one of edge portions of the attaching member, the pulling operating member is arranged in the other end portion, the pulling operating member is arranged in one of the end portions of the other edge portion, and the pressing operating member is arranged in the other end portion of the other edge portion, respectively.

14. A filing apparatus according to claim 4, wherein each coupling mechanism has a facing direction interlocking mechanism, and the operating members are arranged at both edge positions of the relative movement of each coupling mechanism, respectively.

15. A filing apparatus according to claim 14, wherein said facing direction interlocking mechanism comprises a rack and a pinion.

16. A filing apparatus according to claim 14 or 15, wherein each said coupling mechanism comprises: a pair of front and back operating rods which are coupled by said facing direction interlocking mechanism; elastic force applying means for always elastically pressing said pair of operating rods in the contactless direction; and a pair of front and back coupling rods which are respectively retained to said pair of front and back operating rods and are pierced to the axial pipes of the attaching member and the axial pipes of the opening/closing members at the inoperative position to thereby rotatably couple the axial pipes with each other and, when said coupling rods are made operative against the elastic force applying means, enter the axial pipes of the attaching member and release the coupling state with the axial pipes of the opening/closing member.

17. A filing apparatus according to claim 14 or 15, wherein each said coupling mechanism comprises: a pair of front and back operating rods which are coupled to said facing direction interlocking mechanism; elastic force applying means for always elastically pressing said pair of operating rods in such a direction as to be away from each other; and a pair of front and back coupling rods which are respectively retained to said pair of front and back operating rods and are pierced to the axial pipes of the attaching member and the axial pipes of the opening/closing members in the inoperative positions to thereby rotatably couple the axial pipes with each other, and when said coupling rods are made operative against the elastic force applying means, enter the axial pipes of the attaching member and release the coupling state with the axial pipes of the opening/closing members.

18. A filing apparatus according to claim 16, wherein said holding mechanism comprises a locking member which is provided for either one of the front and back operating rods and is constructed in a manner such that when the coupling state of the axial pipes is released, the relative movement of the operating rods is restricted by the retaining means, and when the axial pipes of the opening/closing member coincide with the axial pipes of the attaching member, the locking member acts on the axial pipes of the opening/closing member and releases the retaining means, thereby allowing the relative movement of the operating rods.

19. A filing apparatus according to claim 18, wherein said locking member has at a front edge a retaining portion and an inclined surface which acts on the lower surfaces of the axial pipes of the opening/closing member, a base edge of the locking member is pivotally attached to either one of said pair of front and back operating rods, and an elastic member comprising a spring is disposed in a loaded state between said base end and the other operating rod.

20. A filing apparatus according to claim 16, wherein the operating member is constructed in a manner such that coupling shafts which are pierced to the axial pipes of the attaching member so that they can be freely inserted into and ejected out from the axial pipes are horizontally projected in the lower portion and a notch portion for finger hooking is formed on an inner surface.

21. A filing apparatus according to claim 17, wherein each said operating member integratedly has a wide width portion in an edge portion of the operating rod and guide shafts in outside portions, and said guide shafts are pierced to the axial pipes of the attaching member so that they can be freely inserted into and ejected out from said axial pipes.

22. A filing apparatus according to claim 14 or 15, wherein the arranging relation of the axial pipes, the arranging relation of the coupling mechanisms, and the arranging relation of the holding mechanism are set to be symmetrical in the oblique directions which face.

23. A filing apparatus according to claim 1 or 2, wherein said opening/closing member has a coupling mechanism including a facing direction interlocking mechanism and a holding mechanism, and said coupling rods are pierced to the axial pipes of the opening/closing members so that they can be freely inserted into and ejected out from said axial pipes.

24. A filing apparatus according to claim 23, wherein said opening/closing member comprises: an inner plate in which the filing rods which can be mutually pierced are projected out to an inner surface and said axial pipes are provided in the lower portion and ribs are respectively provided at an upper edge and front and back edges; and an outer plate which is attached in a manner such that an upper edge and front and back edges come into contact with said ribs and a space portion is produced between the inner plate and the outer plate, and the coupling mechanism and the holding mechanism are arranged in said space portion.

25. A filing apparatus according to claim 23 wherein each said coupling mechanism is constructed in a manner such that the coupling rods are respectively provided for a pair of front and back operating plates coupled by the facing direction interlocking mechanism, when the pair of operating plates are moved in one of the facing directions, the coupling rods are respectively projected into the pair of front and back axial pipes of the attaching member from the pair of front and back axial pipes of the opening/closing member to thereby rotatably couple them, and when the pair of front and back operating plates are moved in the other one of the facing directions, the coupling rods respectively enter the pair of front and back axial pipes of the opening/closing member from the pair of front and back axial pipes of the attaching member, thereby releasing the coupling state of them.

26. A filing apparatus according to claim 25, wherein each said coupling mechanism comprises elastic force applying means for always elastically pressing at least one of the pair of front and back operating plates in such a direction that the coupling rods are projected out from the axial pipes of the opening/closing member.

27. A filing apparatus according to claim 25 wherein said facing direction coupling mechanism comprises a pair of rack members which face in the vertical direction and are provided and extended on the pair of front and back operating plates and a pinion which comes into engagement with said rack members.

28. A filing apparatus according to claim 24 wherein said holding mechanism comprises; a holding member which is arranged in a notch concave portion provided in an operating plate so that it can be vertically inclined and is always downwardly inclined by an elastic member and has a retaining claw in a free edge portion and a leg member on a lower surface in which the leg member comes into pressure contact with the axial pipes of the attaching member by the inclining force; and a stop member which is retained to the retaining claw and restricts the movement of the operating plate when said leg member is downwardly rotated by releasing the pressure contact with the axial pipes of the attaching member.

29. A filing apparatus according to claim 23, wherein said operating members comprise operating rods which are respectively arranged at the front and back positions at each of the right and left positions of the attaching member and are slidably fitted into the axial pipes provided for the attaching member, each said operating rod has a finger pressing portion at an outer edge and is pressed by the coupling rod in the coupling state between the attaching member and the opening/closing member and is projected out to a position at which the finger pressing portion can be pressed by the finger, and when the finger pressing portion is pressed by the finger from such a position at which the finger pressing portion can be pressed by the finger, the operating rod presses the coupling rod and leads the coupling rod to a position at which it is ejected out from the axial pipe of the attaching member.

30. A filing apparatus according to claim 23, wherein the filing rod projected to one edge portion of the inner surface of the opening/closing member is a spike-shaped filing rod, and the filing rod projected to the other edge portion is a tubular filing rod.

31. A filing apparatus according to claim 23, wherein the pair of front and back axial pipes provided for the attaching member and the pair of front and back axial pipes provided for the opening/closing member are provided at symmetrical positions from the center in the longitudinal direction, respectively, and axial pipes which come into pressure contact with the leg members of the holding members are provided at the right and left positions of the central portion of the attaching member.

* * * * *